US008117789B2

(12) United States Patent
Teodorovich

(10) Patent No.: US 8,117,789 B2
(45) Date of Patent: Feb. 21, 2012

(54) DOOR AND WINDOW SILL PAN FLASHING WITH DRAIN

(76) Inventor: Mishko Teodorovich, Austin, TX (US)

( * ) Notice: Subject to any disclaimer, the term of this patent is extended or adjusted under 35 U.S.C. 154(b) by 234 days.

(21) Appl. No.: 12/372,232

(22) Filed: Feb. 17, 2009

(65) Prior Publication Data

US 2009/0272045 A1 Nov. 5, 2009

Related U.S. Application Data

(63) Continuation-in-part of application No. 10/730,414, filed on Dec. 8, 2003, now abandoned.

(60) Provisional application No. 60/497,078, filed on Aug. 22, 2003, provisional application No. 60/507,915, filed on Oct. 1, 2003.

(51) Int. Cl.

| | |
|---|---|
| ***E06B 1/70*** | (2006.01) |
| ***E06B 7/14*** | (2006.01) |
| ***E06B 1/04*** | (2006.01) |
| ***E04D 1/36*** | (2006.01) |

(52) U.S. Cl. ..... 52/209; 52/60; 52/210; 49/471

(58) Field of Classification Search ..... 49/467, 49/468, 471; 52/204.5, 209, 204.54, 204.56, 52/58, 212, 210, 60, 211, 204.53, 217

See application file for complete search history.

(56) References Cited

U.S. PATENT DOCUMENTS

| | | | | |
|---|---|---|---|---|
| 1,904,404 | A * | 4/1933 | Burk | 52/62 |
| 4,555,882 | A * | 12/1985 | Moffitt et al. | 52/209 |
| 6,098,343 | A * | 8/2000 | Brown et al. | 52/11 |
| 6,371,188 | B1 * | 4/2002 | Baczuk et al. | 160/92 |
| 6,385,925 | B1 * | 5/2002 | Wark | 52/209 |
| 7,222,462 | B2 * | 5/2007 | Ellingson | 52/62 |
| 2004/0139667 | A1 * | 7/2004 | Massey et al. | 52/204.1 |
| 2005/0144865 | A1 * | 7/2005 | Ellingson | 52/272 |
| 2005/0217189 | A1 * | 10/2005 | Moffitt | 52/209 |

* cited by examiner

*Primary Examiner* — Eileen D Lillis
*Assistant Examiner* — Ryan Kwiecinski
(74) *Attorney, Agent, or Firm* — Rick B. Yeager

(57) ABSTRACT

A window sill pan flashing or a door sill pan flashing with drain. The sill pan flashing has an inclined base, window or door continuous or near continuous sill supports which can be extruded as part of the base unit, and corner elements which can be snapped or otherwise attached to the base. Sill pan flashing offsets provided in the rear sill pan flashing wall and in the front flange create a flow path for water to drain from the sill pan flashing. The base may be solid or hollow with window or door supports extending vertically through the base. The sill pan flashing may be manufactured by extrusion, and corner pieces may be injection molded or otherwise fabricated. The base may be fabricated from fiberglass, metal, or plastic. A window sill support means is provided in a horizontal orientation so that the base can be extruded.

6 Claims, 35 Drawing Sheets

210
220
230
240
242
200
250
260
264
270
262
265
110
170
120
171
172
130
150
100
140
142

270
170
171
172
100
200

250
200
165
164
100

630
640
635
600

630
600
635

630
640
635

DOOR AND WINDOW SILL PAN FLASHING WITH DRAIN

RELATED APPLICATIONS

This application is a continuation-in-part of U.S. patent application Ser. No. 10/730,414, filed Dec. 8, 2003, now abandoned which is related to and claims priority from U.S. Provisional patent application No. 60/497,078 filed Aug. 22, 2003, and U.S. Provisional patent application No. 60/507,915 filed Oct. 1, 2003.

FIELD OF INVENTION

This invention relates to a sill pan flashing for a rough opening of a door or window, where the sill pan flashing drains accumulated moisture from the entire rough opening.

BACKGROUND

In this specification and claims, the term "sill" refers to the horizontal bottom part of a window or door as defined by ASTM E 2112-07 Standard Practice for Installation of Exterior Windows, Doors, and Skylights, section 3.2.121.

In this specification and claims, the term "pan flashing" or "sill pan flashing" refers to "a type of flashing used at the base of rough opening to divert incidental water to the exterior or to the exterior surface of concealed WRB (weather-resistive barrier)," as defined by ASTM E 2112-07 section 3.2.91. As further described in Note 3 to ASTM E 2112-07:

> "sill pan flashing have upturned legs at the interior edge and ends of the rough opening to from a three-sided pan. They are intended to collect and drain water toward the exterior including water that may enter through the window unit (for example, between the jambs and sill) or around the window (between the rough opening and the fenestration). The pan flashing [or sill pan flashing] must be integrated with other flashings and the window assembly to capture water that may otherwise penetrate to the sill framing and allow it to freely drain to the exterior. The window, flashings, and pan are to be sealed in a manner that reliably inhibits air and moisture flow to the interior."

A "sill pan flashing" is different structurally and functionally from a "sill". The sill is a structural part of a window or door assembly that connects bottom of the frame (jamb) members and does not extend to the full width of a rough opening, and does not collect or drain the water that enters around the door or window unit (between the jamb and the rough opening). A sill is not integrated with the Water Resistive Barrier (WRB).

FIG. 24 is a front perspective view provided in ASTM E 2112-07 as an illustration of the sill pan flashing.

It is desirable to provide a relatively low cost sill pan flashing for the entire rough opening to be installed underneath window and door sills for directional drainage of water and moisture which can be used for construction in all price ranges of housing, and for any door or window width. In one embodiment of the current invention, a base unit is provided which can be manufactured by extrusion and either cut to a desired length to fit the door or window width opening, or used with other similar elements and connectors to establish a desired final length. End pieces and optional center joining elements are provided for field assembly.

The prior art includes U.S. Pat. No. 5,921,038 to Burroughs which describes a window sill pan with an inclined plate and ribs perpendicular to the front edge. The patent includes a front cover, but does not disclose end members.

U.S. Pat. No. 6,385,925 B1 to Wark teaches an inclined plate with ribs perpendicular to the front edge. The Wark patent does not include a cover, but does have end members. Wark also describes the possible use of other window support means such as truncated cones. Wark describes the supports as being on the apparently solid inclined base.

It is desirable to provide a sill pan flashing that can be used for doors or windows of any length. It is desirable to provide an economical sill pan flashing that can be used in most construction. One way to provide a relatively low cost device is to extrude the base. It is desirable in such applications to provide window or door supports which can be extruded in relatively long lengths suitable to be cut in the field in order to accommodate different size windows and doors. It is desirable to extrude a unit which includes door or window supports in order to avoid attaching separate support elements to a base unit.

It is desirable to manufacture window and door sill pan flashing elements in an efficient and economical extrusion process, to supply the elements in relatively long lengths, and to cut the elements to a desired length at a construction site. This manufacturing and installation method may provide sill pan flashing units that are more readily available to builders and which are more economical that purchasing prefabricated sizes from a supplier who is required to stock a large number of possible widths. This manufacturing and installation method eliminates the need for special ordering of sill pan flashings for different field dimensions.

Also, if an injection molding tool were required for each size, then relatively high volumes of each size would be required to pay for the tool. It is difficult to order and store many different sizes of sill pan flashing for the variety of window and door dimensions which are used in construction. By designing the sill pan flashing for manufacture by extrusion, a single extrusion tool and a single injection molding tool for end pieces can provide sill pan flashing of a variety of lengths. In some embodiments, sections of base may be connected to establish a desired length. In other embodiments, the base may be cut to a desired length.

SUMMARY

The current invention is for a window sill pan flashing or door sill pan flashing. In some embodiments of the current invention, the device can be made in a low cost manufacturing operation by extrusion. In one embodiment, SureSill™ is made by combining extrusion and injection molding processes. The sill pan flashing typically includes an inclined base, window or door supports which can be extruded as part of the base unit, and corner elements which can be snapped or otherwise attached to the base.

In some embodiments, the base may be solid. In other embodiments, the base may be hollow with window or door supports extending vertically through the base. In the case of fiberglass construction, the base may include a slanted upper face, but no lower face.

In one embodiment, the sill pan flashing has offsets provided in both a rear sill pan wall and in a front flange. These offsets create a flow path for water to drain from the rough opening.

In one embodiment, the sill pan flashing includes corner side flanges that are preferably provided without openings, and the sill pan flashing is secured in a window or door opening by stapling across a corner of the side flange, by bending a nail over the flange, or by nailing through the flange.

In some embodiments, the window support means is provided in a horizontal orientation so that the base can be extruded. In other embodiments, the base may be fabricated from fiberglass, metal, or molded plastic, and may not have a horizontal orientation.

In other metal or plastic embodiments, the sill pan flashing is provided as a center piece that can be cut to a desired length, and as end elements that can be snapped or glued to the center piece.

In one embodiment, an extruded base unit is cut to a desired length, and an installation tolerance is provided in corner units which slide onto the base unit.

In another embodiment, a base unit is provided in two or more sections which slidably overlap in a manner that compensates for rough framing tolerances, so that the sill pan flashing can be adjusted to cover the entire rough opening width.

BRIEF DESCRIPTION OF THE DRAWINGS

These and other objects and advantages of the present invention are set forth below and further made clear by reference to the drawings, wherein.

DETAILED DESCRIPTION OF EMBODIMENT

Plastic Sill Pan Flashing with Extruded Base Cut to Desired Length

Figure 1:
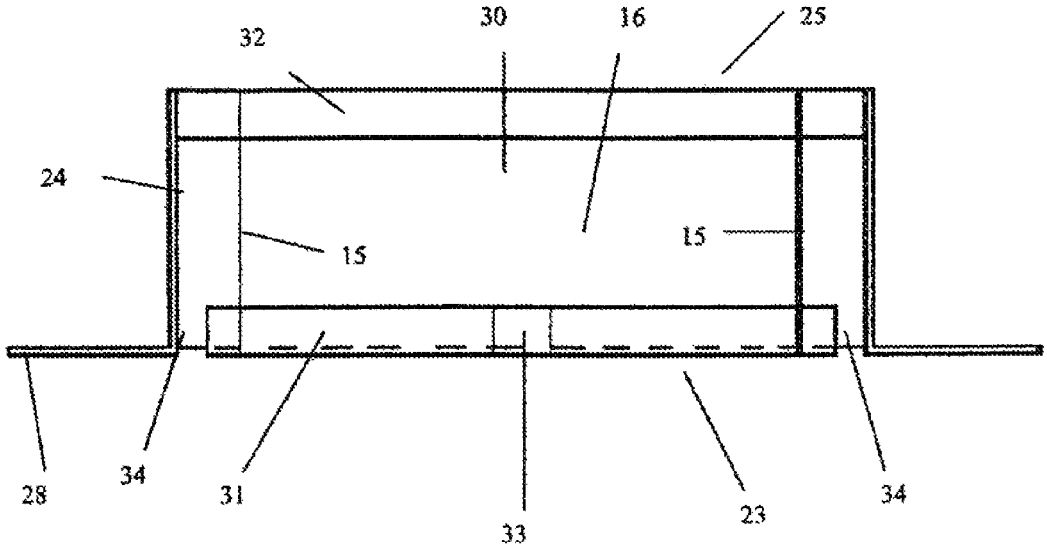
FIG. 1 is a top view of an embodiment of the invention

Referring now to FIG. 1, which is a top view of a single sill pan flashing, the sill pan flashing includes a base 30 with a downwardly sloping top surface. The sill pan flashing has a front support ridge 31 and a rear support ridge 32 for supporting a window or door. The window or door typically includes a horizontal sill which is supported by the sill pan flashing of the current invention. In this embodiment, the sill pan flashing includes an extruded middle piece 16, or lock-in channel plate, and end pieces 15, or, lock-in corners, which may be molded or provided by other manufacturing processes. Pieces are typically joined with cement such as PVC glue or with a snap together feature.

Figure 2:
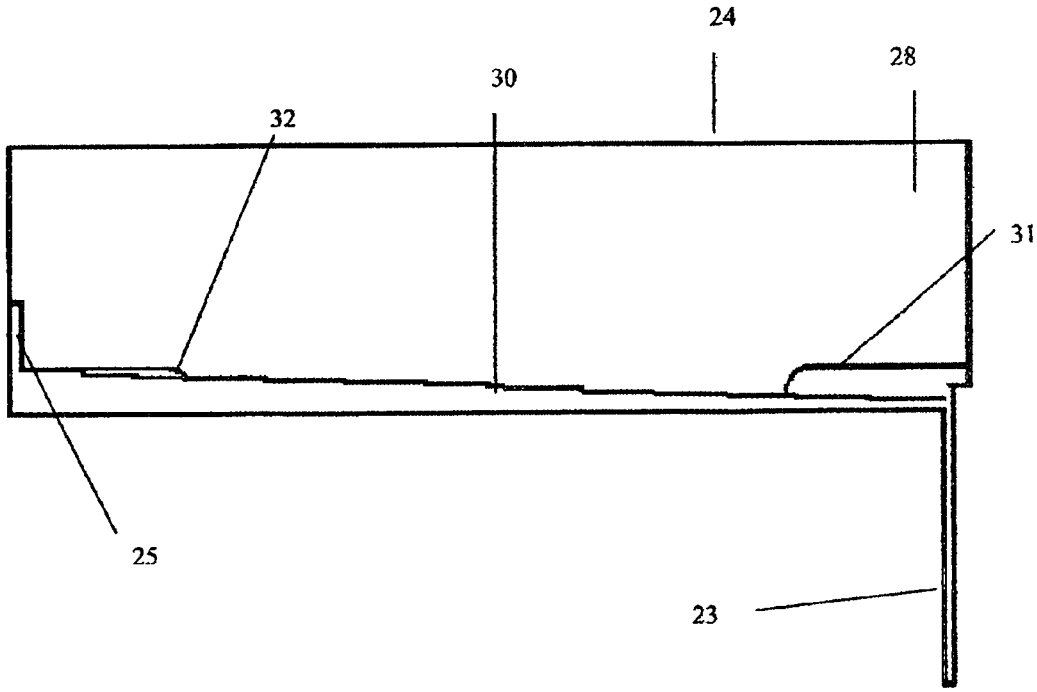
FIG. 2 is a side cross section view of the embodiment of FIG. 1.

Referring now to FIG. 2 which is a side view of the sill pan flashing embodiment of FIG. 1, the base 30 has a slope from the rear portion of the sill pan flashing to the front portion The front support ridge 31 is solid through the base so that it rests on the bottom and the rear support ridge 32 is also solid, thereby transmitting the weight of the window or door to the support area for the sill. Wall thickness for the walls can be approximately ⅛ of an inch thick. In one embodiment the front support pedestal has a width of approximately ¾ of an inch, and the rear support pedestal has a width of approximately 1 inch.

As shown in the FIGS. 1 and 2, this embodiment includes a rear wall 25 and a downward extending lip 23. The rear wall may include offsets (not shown) to provide a drain path between the rear wall and the window or door. The downward extending lip 23 may include an offset to provide a drain path between the sill pan flashing and the siding or other materials installed around the window or door. These offsets create a drain path for moisture which might become present in the rough opening.

In this embodiment the front ridge may further include a gap 34 between the support ridge and the sides and may further include a drain channel 33 to permit the drainage of moisture. The corner pieces include a side upward lip 24 and a downward lip 23.

Figure 3:
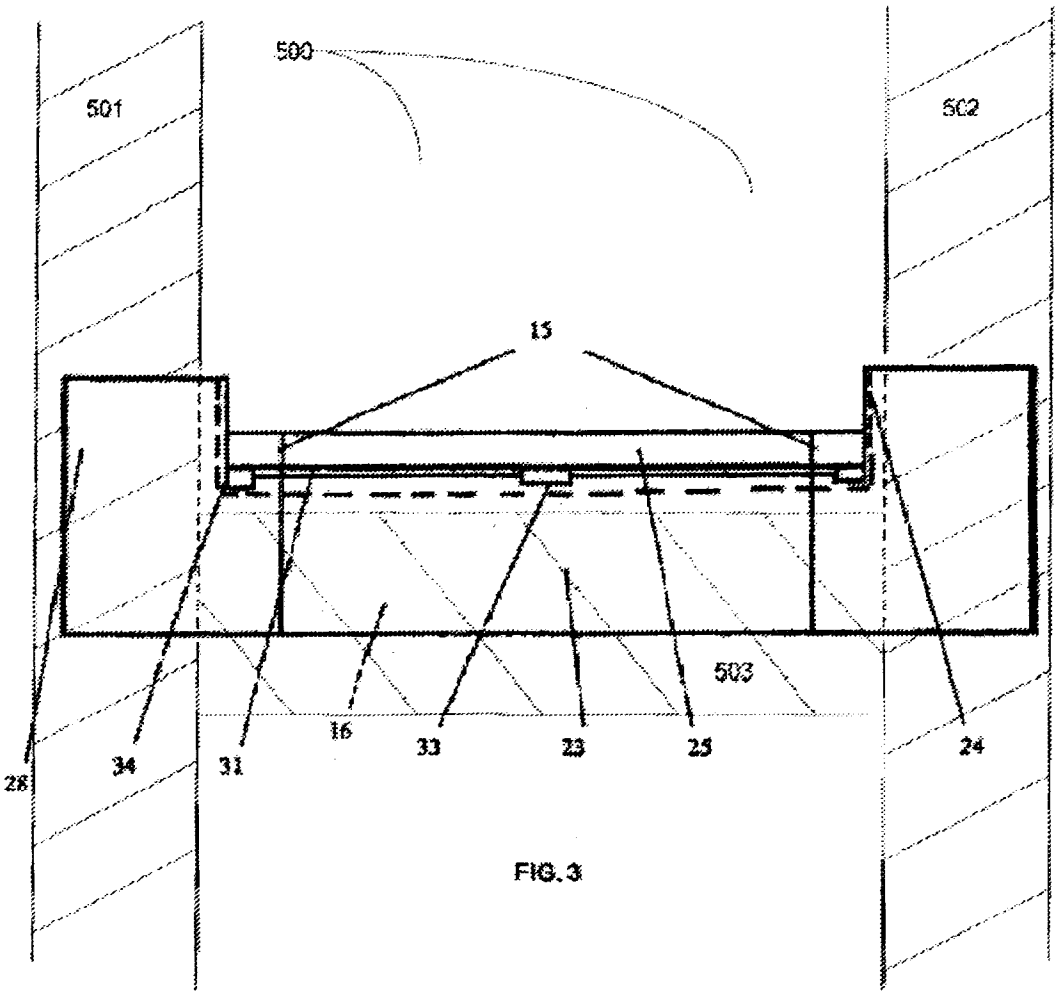
FIG. 3 is a front view of the embodiment of FIG. 1.

Referring now to FIG. 3 which is a front view of the embodiment of FIG. 1, the front support ridge 31 includes gaps 33 and 34 for drainage.

Figure 4:
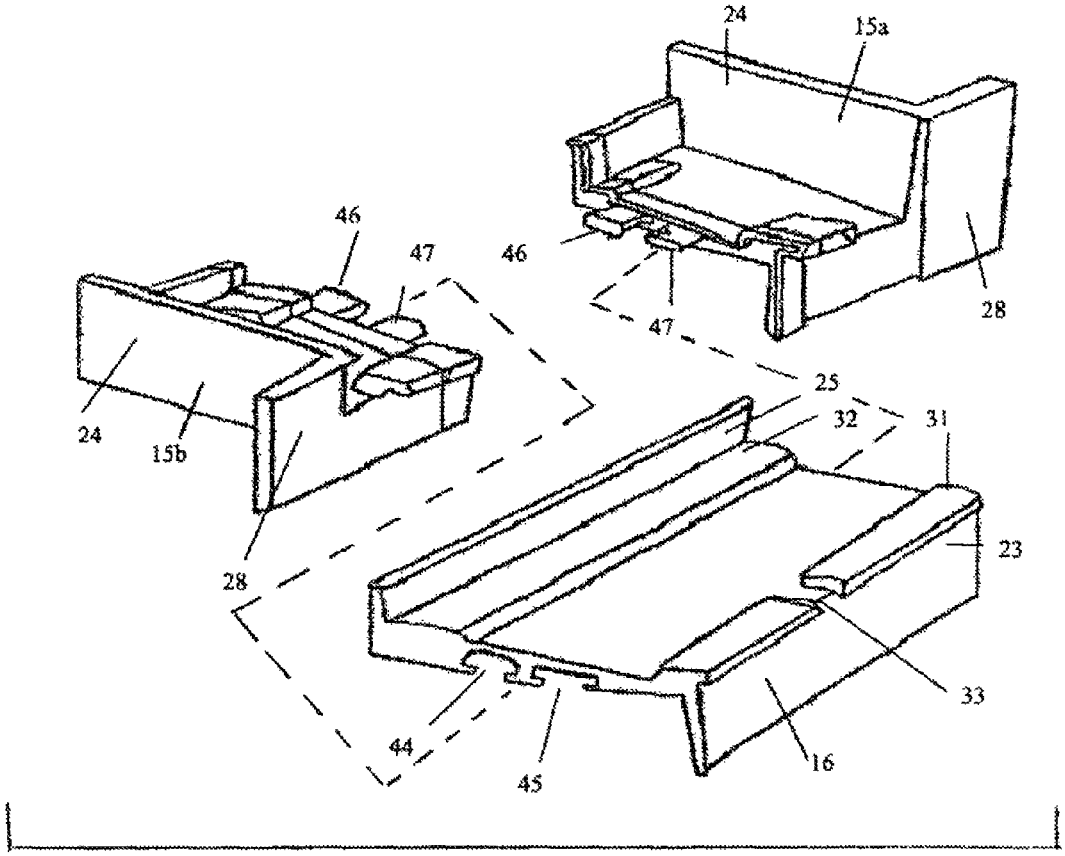
FIG. 4 is an exploded view of an embodiment with a base element and corner elements.

FIG. 4 is an exploded view of an embodiment with a base element and end elements. In this case the extruded middle piece 16 includes a first channel 44 and a second channel 45. The right corner element 15A includes a first tab 46 which fits into the first channel 44, and a second tab 47 which fits into the second channel 45. The left corner element 15B also includes a first tab 46 which fits into the first channel 44, and a second tab 47 which fits into the second channel 45. The tabs and channels create an interlocking between the middle piece and the corner elements.

Figure 5:
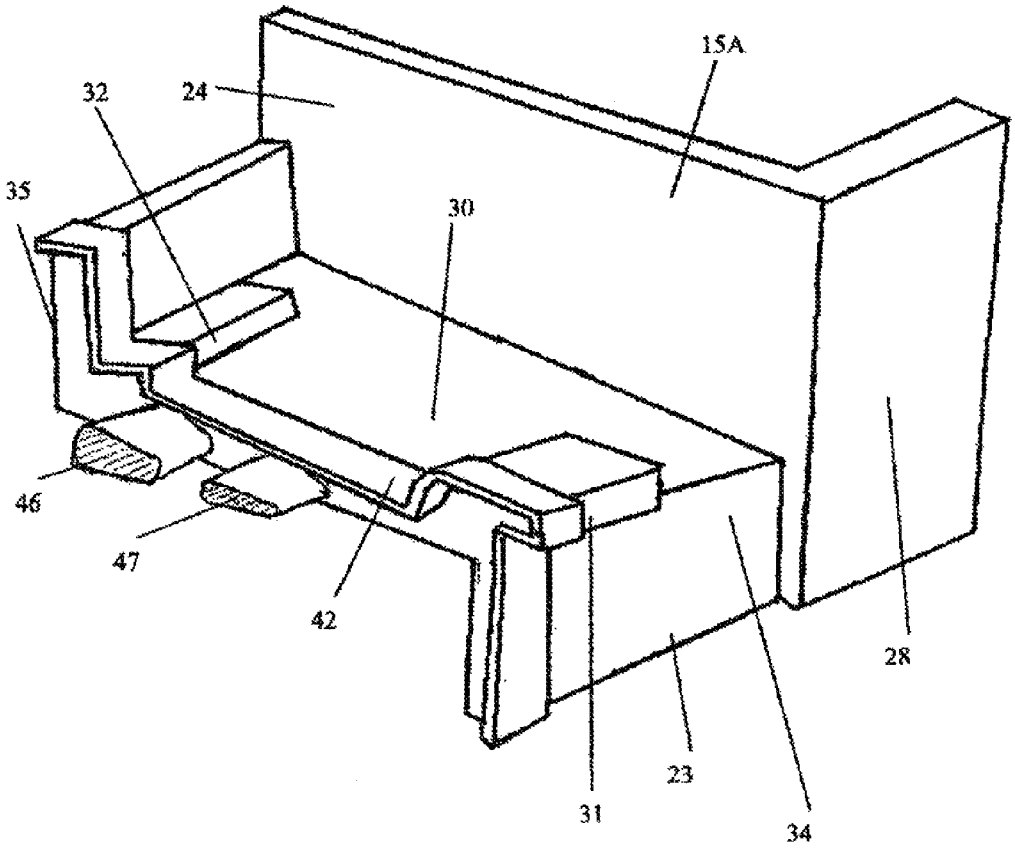
FIG. 5 is an enlarged detail perspective view of the right end element of the embodiment of FIG. 4.

FIG. 5 is an enlarged detail view of the right end element 15A of the embodiment of FIG. 4. In this embodiment, the corner element includes a first tab 46 or alignment extension which may be inserted into the first channel 44 in the base portion; a second tab or alignment extension 47 may be inserted into the second channel 45 in the base portion; and an overlapping lip 42.

DETAILED DESCRIPTION OF EMBODIMENT

Method of Manufacturing Extruded Base

It is desirable to provide a relatively low cost product which can be used for construction in all price ranges of housing. In one embodiment of the current invention, a base unit is provided which can be manufactured by extrusion to a common long length, such as 16 feet, and cut to a desired length.

In this embodiment the base has longitudinal features, such as illustrated in FIGS. 1 and 2, that can be extruded. For instance, the cross section of the base is consistent throughout the length so that the rear support is the same height throughout the length of the base, and the front support is the same height throughout the length of the base.

A drill or cut operation may be included to provide one or more drain slots in the support member front support so that water may drain from the sill pan flashing.

End segments which are molded or otherwise produced may be attached to a desired length of base in order to provide a completed sill pan flashing unit.

DETAILED DESCRIPTION OF EMBODIMENT

Metal Sill Pan Flashing

A metal sill pan flashing or a plastic sill pan flashing may be manufactured by extrusion as described above.

Figure 6:
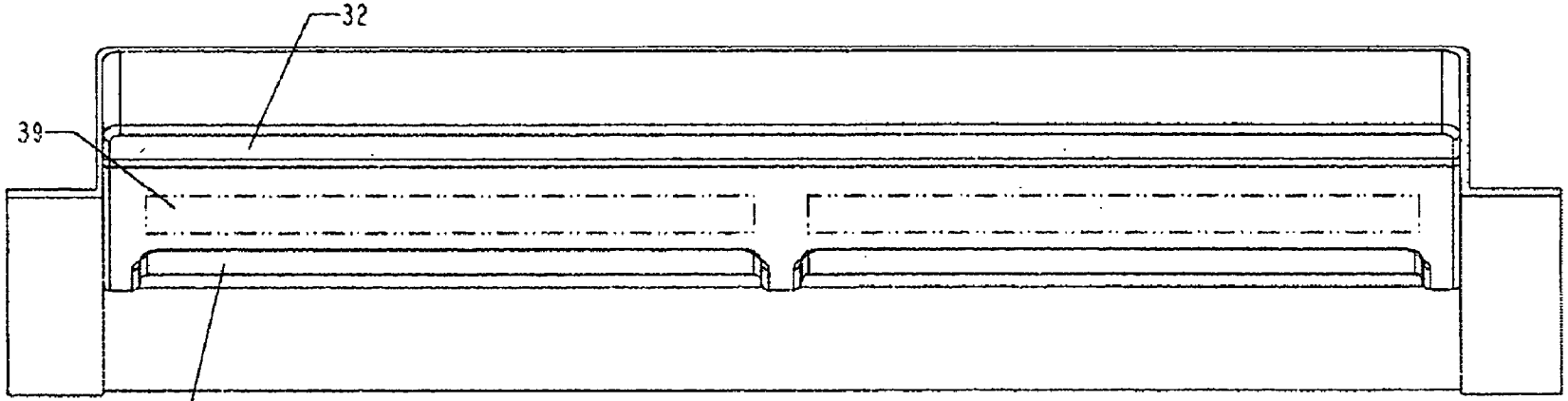
FIG. 6 is a metal embodiment of the invention with a lateral additional central ridge.

Referring now to FIG. 6, which is another metal embodiment of the invention, the sill pan flashing may include a center support ridge 39 which includes drain-hole areas. In this example the sill pan flashing is fabricated from a metal such as stainless steel. Other metals such as copper, lead, or aluminum may also be used.

The metal sill pan flashing may also be produced by welding or otherwise securing the metal members.

DETAILED DESCRIPTION OF EMBODIMENT

Sill Pan Flashing with Extruded Base Sections Joined by Connectors to Form a Desired Length In this embodiment the middle base may be constructed from two or more relatively short pieces which are joined by connector segments on one or both ends to achieve a desired length. In one connector embodiment, each end of the connector includes tabs such as 46 and 47 shown in FIGS. 4 and 5. These tabs fit into channels 44 and 45 on the base unit segments. The sill pan flashing also comprises end pieces which may be snapped onto or glued to the ends of the base unit.

DETAILED DESCRIPTION OF EMBODIMENT

Fiberglass

In this embodiment, the door or window is supported by a rear support element and a front support element of a fiberglass sill pan flashing.

Figure 7A:
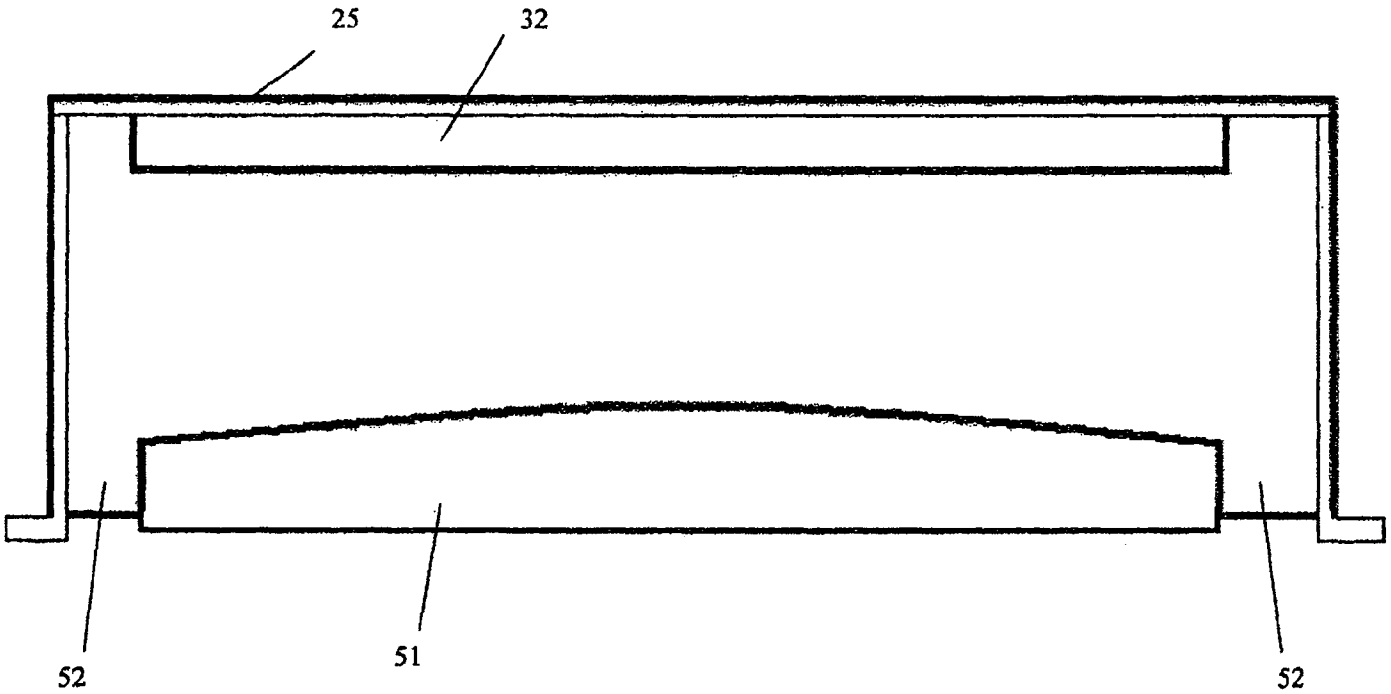
FIG. 7A is a top view of a fiberglass embodiment of the invention.

FIG. 7A is a top view of a fiberglass sill pan flashing which includes a rear support 32 and a front support 51 which tapers in plan toward drainage openings 52. This taper directs water to the drainage openings. The drainage openings such as gaps, holes, or slots are typically provided at the ends of the front support, and may also be provided at one or more locations along the length of the support. Alternatively, weep holes may be provided in the front support. The weep holes may be formed as part of a molding operation in fiberglass or as a post extrusion process step for metal or plastic sill pan flashing.

Figure 7B:
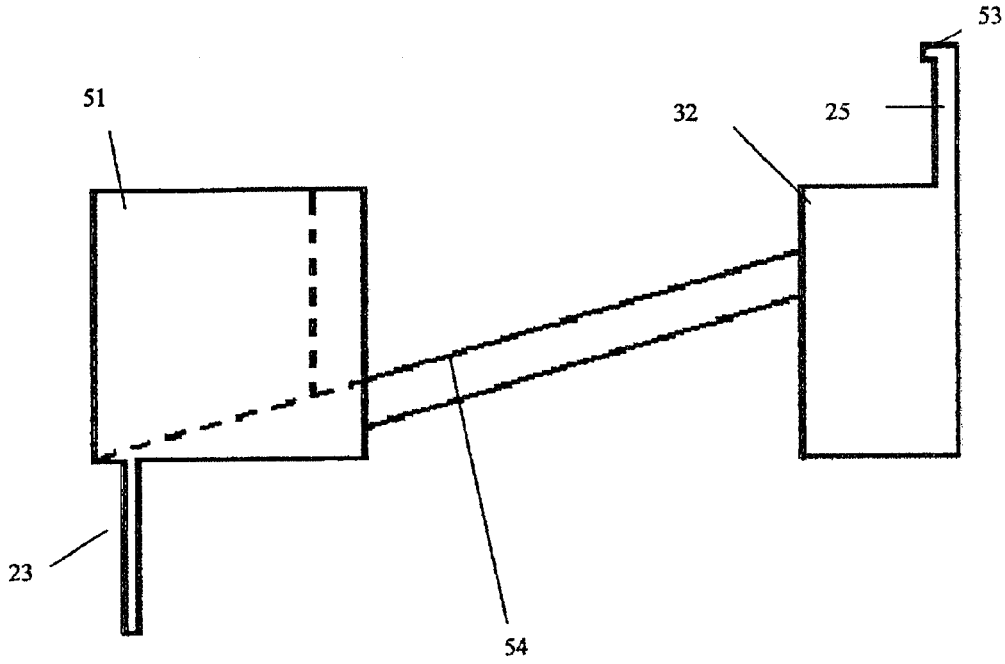
FIG. 7B is a cross section view of the fiberglass embodiment of FIG. 7A.
Figure 7C:
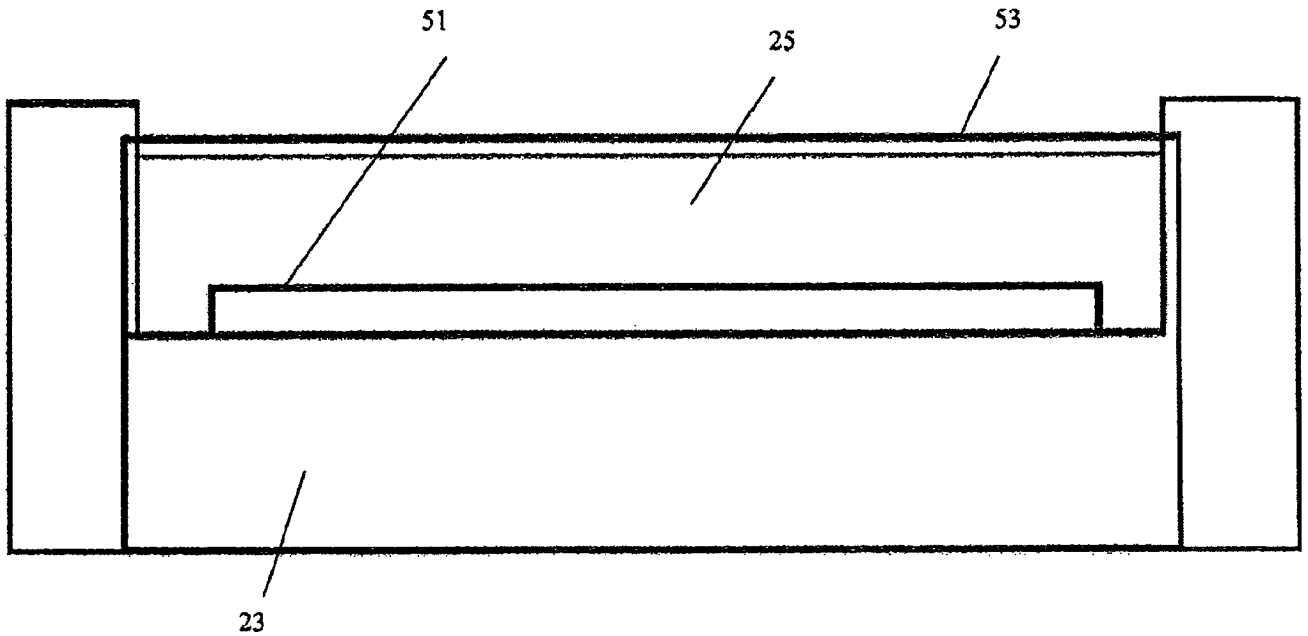
FIG. 7C is a front view of a fiberglass embodiment of FIG. 7A.

FIG. 7B is a cross section view of the fiberglass sill pan flashing of FIG. 7A, and FIG. 7C is a front view of the sill pan flashing. The rear wall may include a lip 53, The front edge of the rear support 32 may be tapered for ease of manufacture. In this embodiment, the sill pan flashing includes a sloping drain surface 54. In this example, the fiberglass base does not have a solid surface on the bottom, and the front and rear support ridges extend to the bottom of the sill pan flashing, and no additional supports are required for the sloping drain surface 54. If the sloping drain surface were load-bearing, then additional supports may be provided.

DETAILED DESCRIPTION OF EMBODIMENT

Alternate Fiberglass Sill Pan Flashing

Figure 12B:
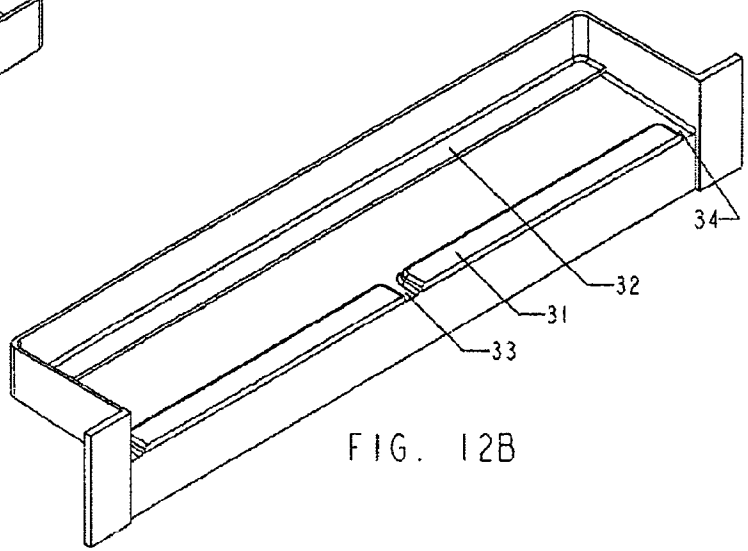
FIG. 12B is a perspective view of a fiberglass sill pan flashing embodiment.
Figure 12A:
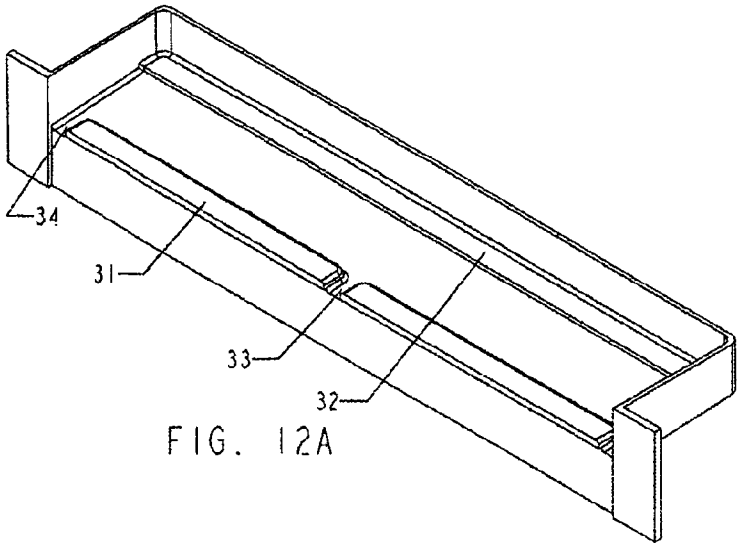
FIG. 12A is a perspective view of a fiberglass sill pan flashing embodiment.

FIGS. 12A and 12B are front perspective views of an alternate fiberglass sill pan flashing. In this embodiment, the window or door is supported by a rear support 32 and a front support 31. In this embodiment, the front support is not tapered as in the previous example. Drain slots 33 and 34 are provided in the front support in order to remove water from the sill pan flashing.

DETAILED DESCRIPTION OF EMBODIMENT

Extruded Base with Alternate Interlocking End Pieces

Figure 8:
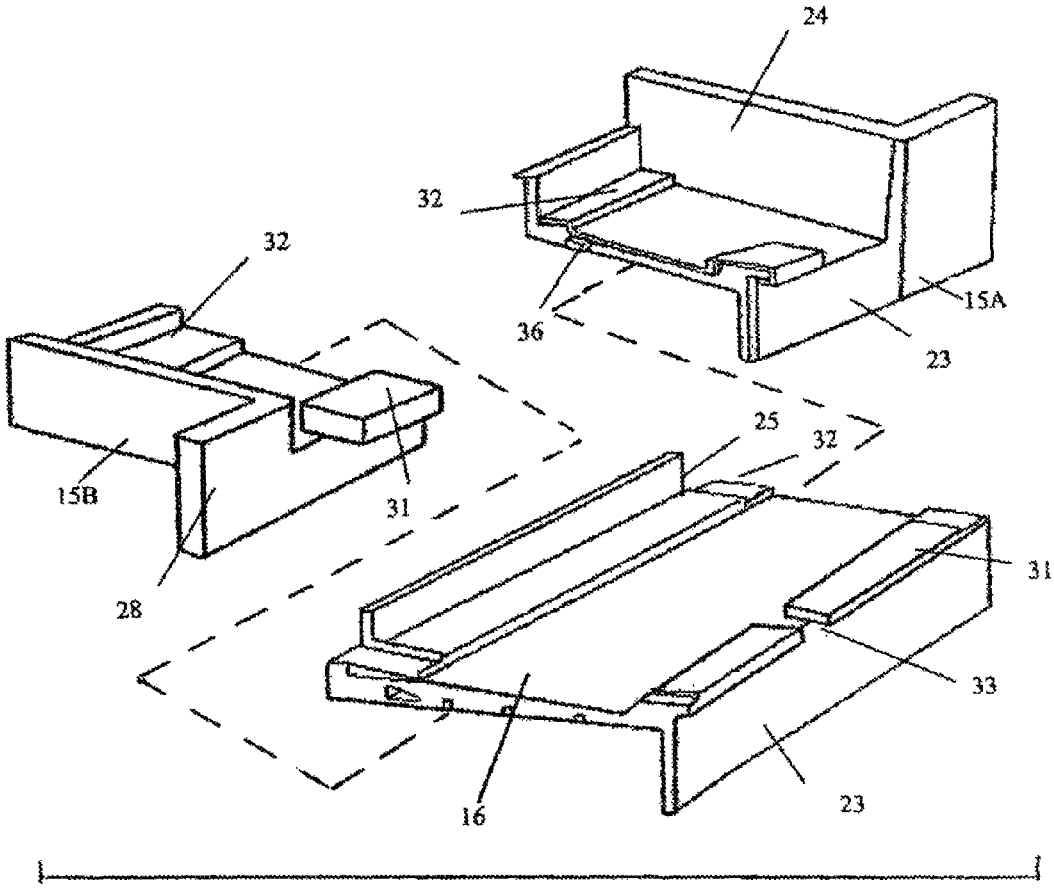
FIG. 8 is an exploded view of an alternate embodiment with a base element and end elements.

FIG. 8 is an exploded view of an alternate embodiment with a base element 16 and corner end elements 15A and 15B. In this embodiment, the end pieces are designed to fit over cut down portions to the front support 31 and rear support 32 and rear wall 25 so that the front and rear supports are essentially constant height across the assembled sill pan flashing. In this embodiment, the base element 16 is typically produced by extrusion, and right and left end pieces 15A and 15B are typically molded, such as by injection molding.

Figure 9:
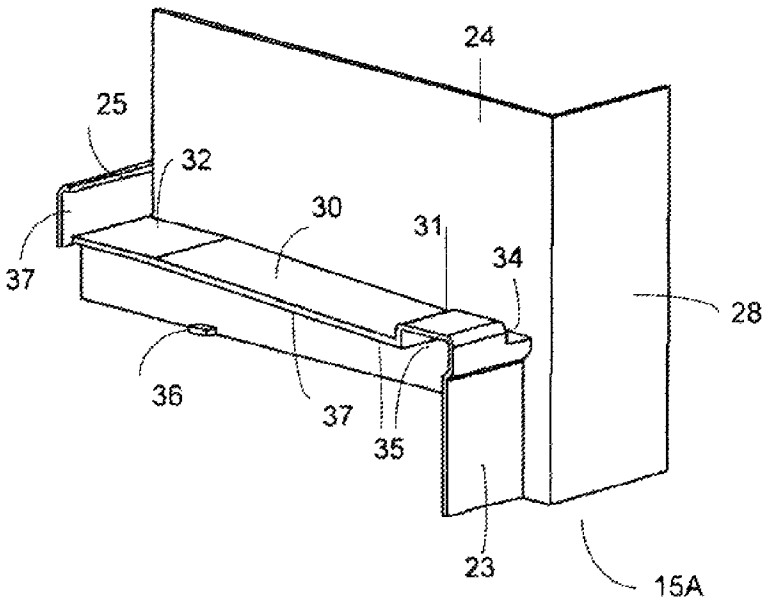
FIG. 9 is an enlarged detail view of a right end element for the embodiment of FIG. 8.

Referring now to FIG. 9 which is an enlarged detail view of a right end element 15A for the embodiment of FIG. 8, the end element includes a an overlapping lip 35 which fits over a portion of the right end of the base. The overlapping lip includes a rear portion which fits over a portion of the rear wall of the right end of the base, a rear support portion which fits over a portion of the rear support of the right end of the base, a middle portion which fits over a portion of the right end of the base between the rear support and the front support, a front support portion which fits over a portion of the front support of the right end of the base, and a front lip portion which fits over a portion of the front lip of the right end of the base. Preferably, the overlapping lip overlaps the right end of the base in a manner that keeps the rear support and the front support substantially level across the sill pan flashing. This end piece, also described as a lock-in corner, is preferably molded such as by injection molding, or vacuum forming.

Figure 10:
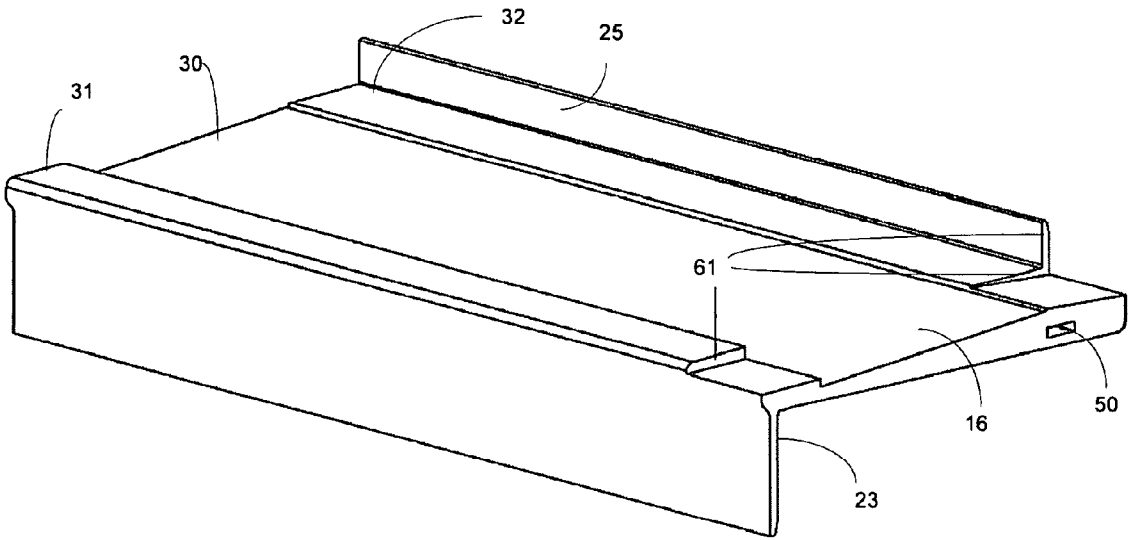
FIG. 10 is a perspective view of a lock in channel base plate for the embodiment of FIG. 8.

Referring now to FIG. 10 which is a perspective view of a lock-in channel base plate 16 for the embodiment of FIG. 8, the right end of the base plate or lock in channel plate is preferably provided with incisions 61 on the front support plate 31, on the rear ridge 32, and on the rear upward lip 25. In one embodiment, these incisions are prepared after cutting a standard length of extruded sill pan flashing base, such as a 16 foot length, to a desired length. The incisions remove a portion of the right end of the front support plate 31, the rear ridge 32, and the rear upward lip 25 as shown in FIG. 10. This removal may be accomplished by cutting a plastic or metal piece to the desired depth with a hacksaw or other cutting tool. In some cases, the cut material may be removed by a chisel. In other cases a special cutting tool may be provided.

Figure 11:
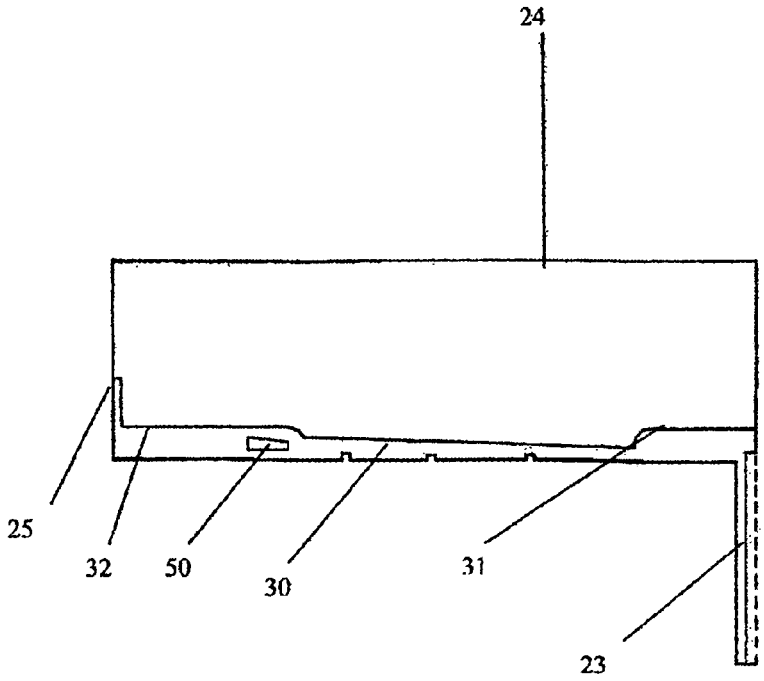
FIG. 11 is a cross sectional view of the base element for the embodiment of FIG. 8.

Referring now to FIG. 11 which is a cross sectional view of the base element for the embodiment of FIG. 8, the base plate includes a keyed channel 50 for receiving a keyed profile 36 from the corner element. In some embodiments, the rear upward lip 25 may be extended downward or back and downward, to provide a surface that can be nailed or screwed into the window or door framing elements. The base preferably includes a plurality of channels that can be used to accept an excess of a sealant or adhesive that may be used to set the window or door sill. Although it is desirable to provide a level window or door opening, in practice it is often difficult to achieve a level framing. In such cases, the sill pan flashing may be set on an adhesive, such as PL 400 or PL Premium, by Osi Sealants, Inc.; or on a sealant such as NP1 by Sonneborn, by Chemrex.

In one embodiment, a window may be set into the sill pan flashing and attached to the front ridge, by an adhesive. Drainage holes or slots in the front ridge are open, or will open, to direct the moisture to the outside.

DETAILED DESCRIPTION OF EMBODIMENT

Extruded Plastic Base with UV Resistance

In this embodiment, the base is extruded from a plastic such as PVC, polyvinyl chloride. The plastic includes ultraviolet light (UV) inhibitors that prevent the UV light from breaking down the plastic.

DETAILED DESCRIPTION OF EMBODIMENT

Extrusion and Cutting Process

It is desirable to develop an extrusion process for plastic or metal sill pan flashings. In some embodiments, door or window supports may be provided in a lateral orientation to permit the supports to be extruded. In an alternate embodiment, the base unit may be extruded as a solid piece and then post-processed with a cutting operation to remove material.

Figure 13A:
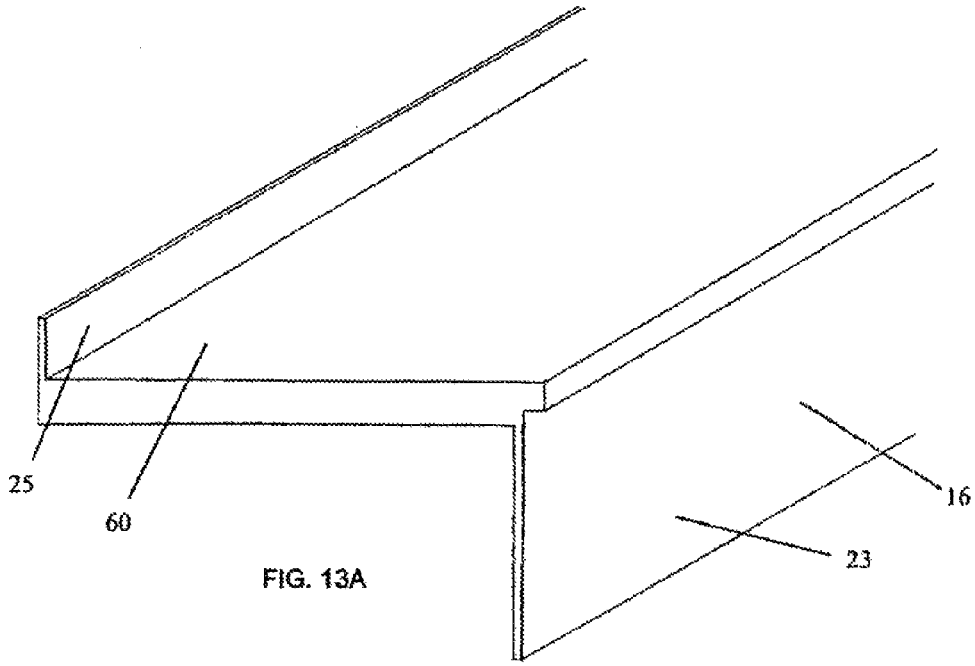
FIG. 13A is a top perspective view of an extruded sill pan flashing section.
Figure 13B:
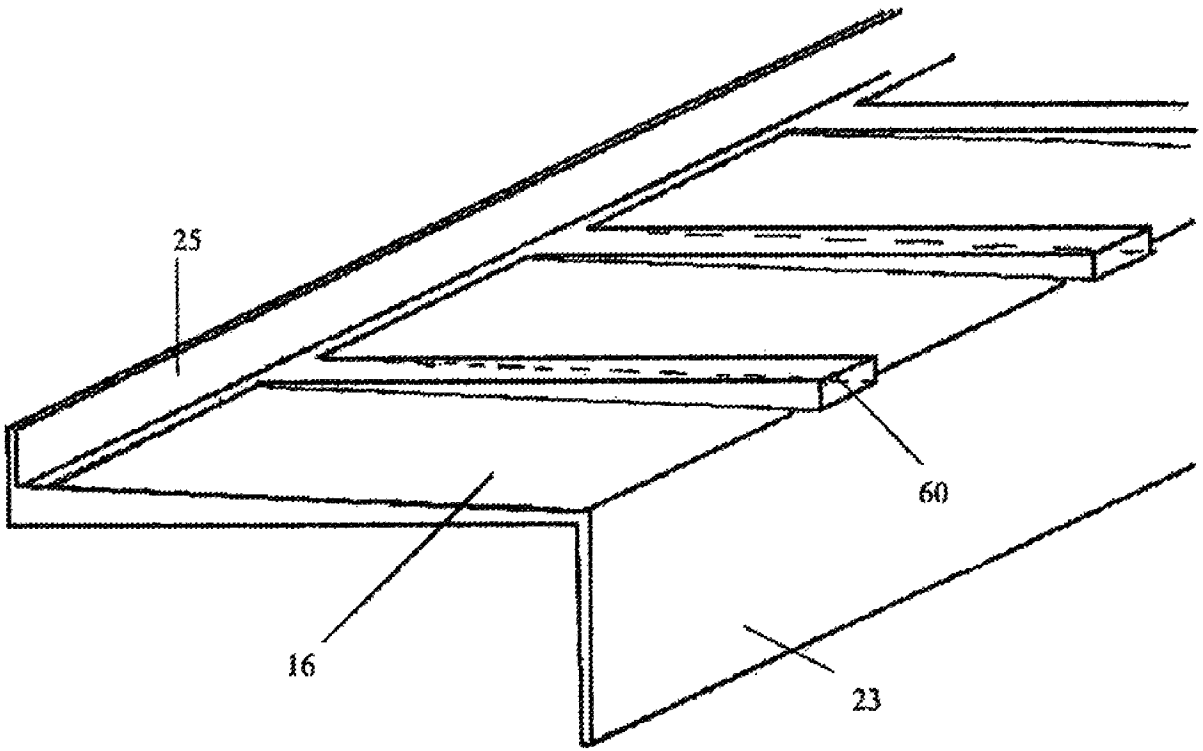
FIG. 13B is a perspective view of the extruded sill pan flashing section of FIG. 13A with material removed in order to create a drain path.

For example, the base plate can be extruded with no slope on the top surface 60 as illustrated in FIG. 13A, so that the top surface is parallel with the bottom surface. After extrusion, the base plate can be inserted in a tool, such as punch press, saw, or combination, or device to make incisions in the top surface. In one embodiment, incisions 62, as shown in FIG. 13B, have a downward slope towards the front of the sill pan flashing, and may be perpendicular to the sill pan flashing or at an angle with respect to the sill pan flashing. For example, incisions can be 3" wide, and ½" apart. Incisions create drainage channels, and spaces between incisions create offsets to permit a drain path. Offsets typically have a coplanar surface and are used as support for installation of windows and doors.

Figure 14A:
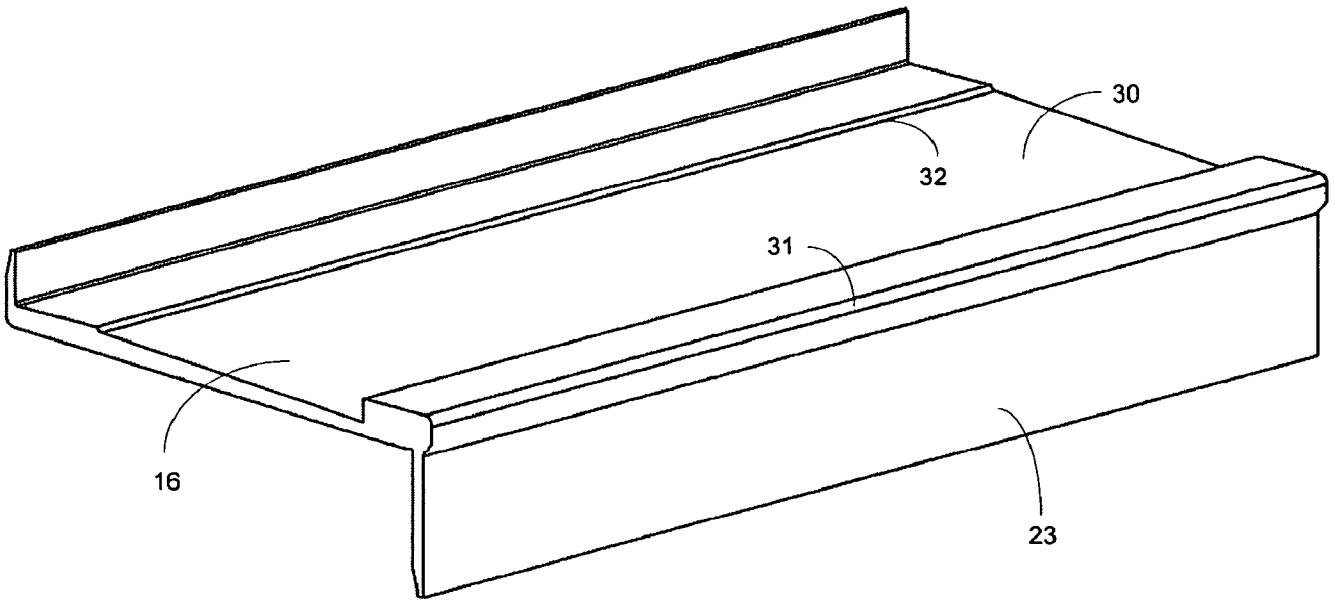
FIG. 14A is a top perspective views of another embodiment of an extruded sill pan flashing section.
Figure 14B:
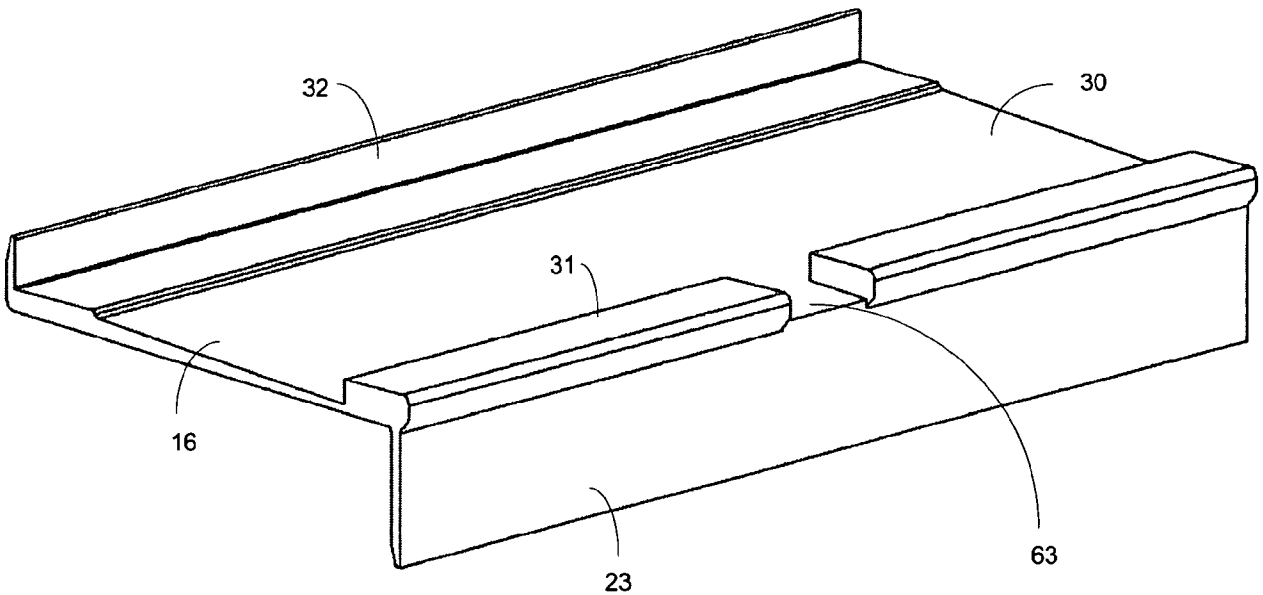
FIG. 14B is a top perspective view of the extruded sill pan flashing section of FIG. 14A with a drain slot.

In another post-extrusion processing example, an extrusion creates the middle piece or lock-in channel plate 16 as described in embodiments above. The top surface of the sill pan flashing 30 is sloped toward the front of the sill pan flashing. The extruded section has a front support ridge 31 and a rear support ridge 32 which are typically coplanar. One or more intermediate ridges may be provided between the front ad rear support ridge. After extrusion, this middle section 16 can be inserted in a tool, such as punch press or saw, or other device that makes cuts in the front and intermediate ridges in order for water to drain downwardly and outwardly through the ridges. The bottom of the incisions 63 as shown in FIG. 14B would have coplanar surface with the sloping top surface 30 of the lock-in channel plate. For example, incisions can be ½" wide, 12" apart. This embodiment shows example with perpendicular incisions on the front ridge, and other incision orientations are possible. In another embodiment, the auxiliary ridges may drain to the ends of the ridge, without additional drain slots in the middle of the ridges. This embodiment shows example with perpendicular incisions on the front ridge, and other incision orientations are possible.

DETAILED DESCRIPTION OF EMBODIMENT

Extruded Base with Alternate Interlocking End Pieces

Figures 15A, 15B:
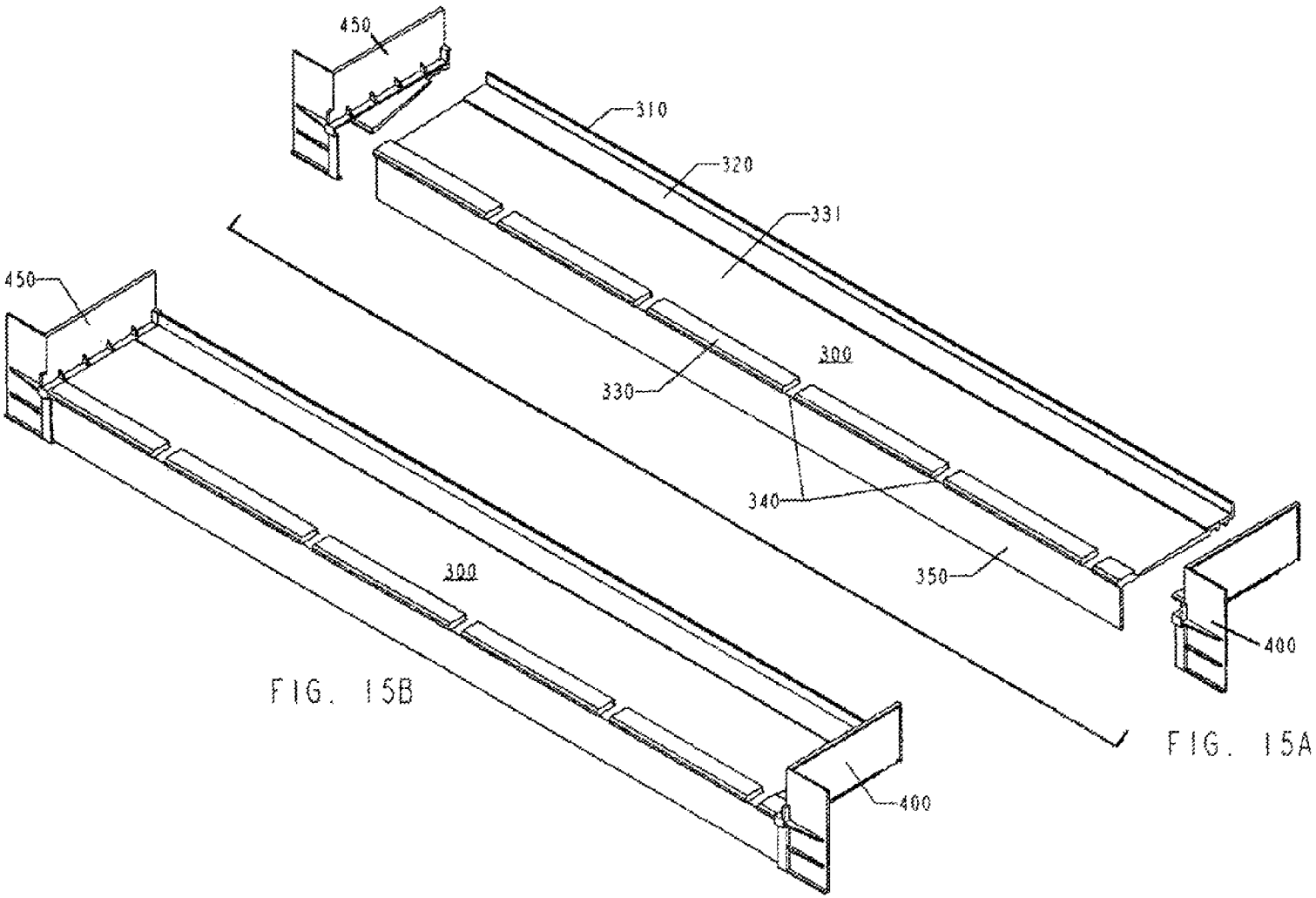
FIG. 15A is an exploded top perspective view of a sill pan flashing base and corner units.
FIG. 15B is a top perspective view of the assembled base and corner units of the sill pan flashing of the embodiment of FIG. 15A.
Figure 15C:
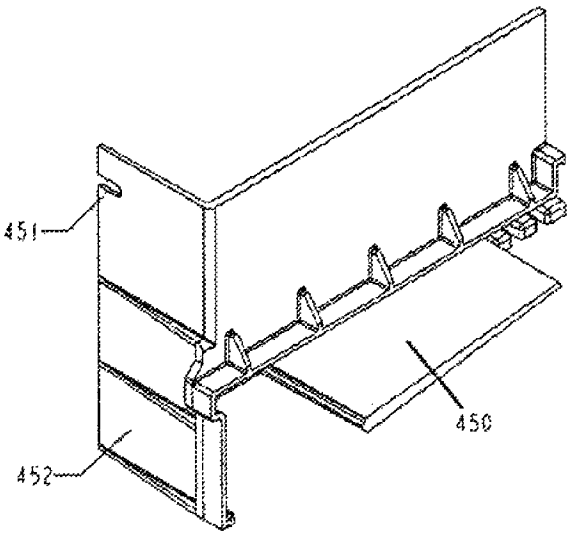
FIG. 15C is a top perspective view of an alternate embodiment of a right end element.

FIG. 15A is an exploded top perspective view of a base 300 which may be extruded and corner units 400 and 450 which are typically molded. The base includes a rear wall 310, a rear support 320, a base top surface 331 which may be sloped, a front support 330 with drain gaps 340, and a front face 350. In this embodiment, the drain gaps are preferably provided on 6" centers. FIG. 15B is a top perspective view of the assembled base 300 and corner units 400 and 450 of FIG. 15A. FIG. 15C is a top perspective view of an alternate embodiment of a right end element 450 which includes a nail slot 451 in the side flange 452. In this embodiment, the nail slot has a height of about 0.13 inches.

Figure 16:
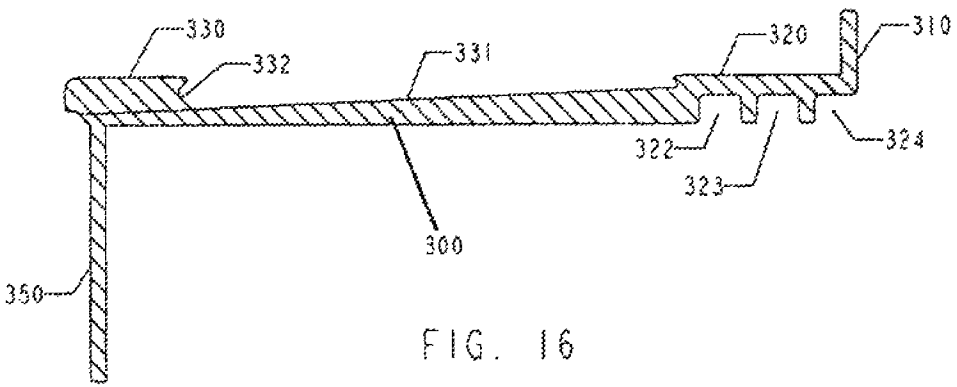
FIG. 16 is a detailed cross section view of the base of the embodiment of FIG. 15A.

FIG. 16 is a detailed cross section view of the base 300 of FIG. 15A. In this example, the front support 330 overlaps the front face 350, and includes an inset rear face 332. The rear support 320 includes recesses 322, 323, and 324 for engaging tabs from a corner element. In one example, the base has a depth of about 4.688", a front support width of about 0.722", a rear support width of about 0.989", and rear wall and front face thicknesses of about 0.94". In this embodiment the base top surface has a slope of about 1.7 degrees.

Figure 17B:
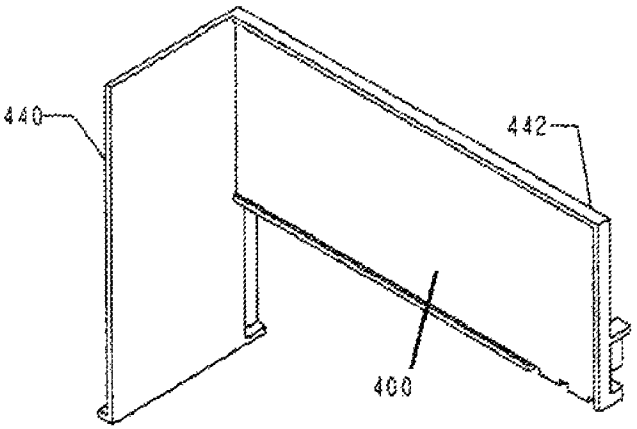
FIG. 17B is a rear perspective view of the right corner unit of the embodiment of FIG. 15A.
Figure 17C:
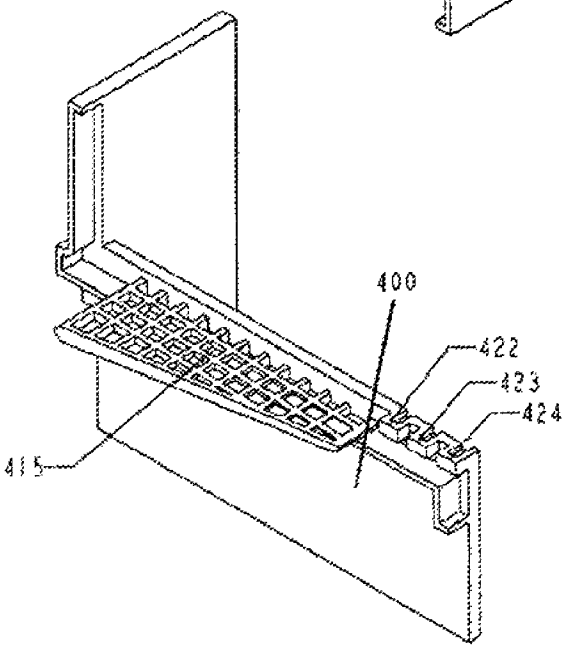
FIG. 17C is a bottom perspective view of the right corner unit of the embodiment of FIG. 15A.
Figure 17A:
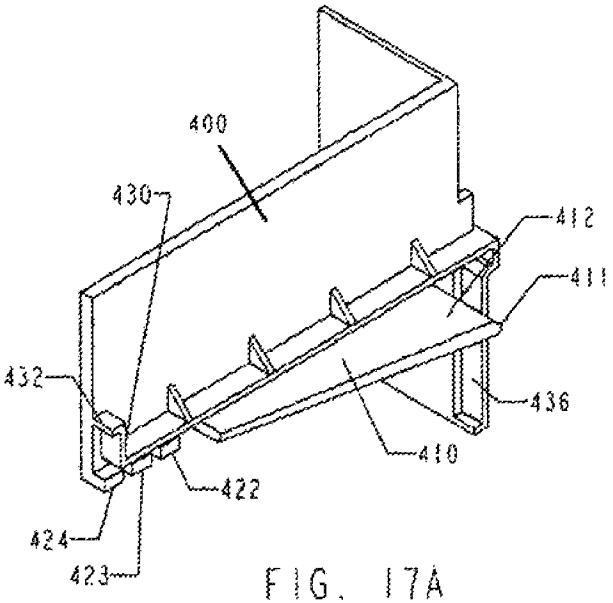
FIG. 17A is a front perspective view of the right corner unit of the embodiment of FIG. 15A.

FIGS. 17A and 17B are front and rear perspective views of a right corner unit 400 which includes a front face 440 and a side face 442. In this example, the corner unit has several overlap features to snap or press fit with a base unit so that the sill pan flashing can be assembled without glue or adhesive if desired. An overlap tab 410 is provided with a width selected to form a press fit between the front edge of the rear support 320 and the inset rear face 332 of the front support 330. In this example, the tab has a convex front face 411 to fit with the inset rear face 332 of the front support. The width of tab 410 is preferably slightly tapered on the end so that the fit becomes tighter as the corner is inserted on the base 300. This tab has a top surface 412 that aligns with the top surfaces of the rear and front supports. In this example, the corner unit also includes a rear wall 430 and a lip 432 which overlap the base rear wall 310, and a front inset portion 436 which overlaps the front face 350 and front end of the front support 330.

FIG. 17C is a bottom perspective view of the right corner unit 400 which shows rear tabs 422, 423, and 424 which mate in the base section recesses 322, 323, and 324 respectively. These tabs are also preferably slightly tapered on the ends.

In this example, the left corner unit 450 is symmetrical to the right corner unit and includes similar tabs and overlap features.

This embodiment permits a sill pan flashing base section to be cut to a desired length in the field for fitting a particular opening. The corner piece elements are then installed on the base section, and the assembled sill pan flashing is placed on the bottom of the rough opening, so that the assembled sill pan flashing provides directional drainage for the entire rough opening. The window or door is then installed on top of the sill pan flashing and inside the rough opening.

DETAILED DESCRIPTION OF EMBODIMENT

Adjustable Sliding Joint

In this embodiment, the sill pan flashing comprises a first section which includes a first corner and a portion of the base, and a second section which includes a second corner and a portion of the base. These sections are designed to slide together without adhesive in a manner that provides for a framing tolerance of several inches. For wider openings a third center section is provided.

Each portion of base includes a lower part offset from an upper part. In one section, the upper part extends past the lower part, and in the other section the lower part extends past the upper part. These extensions provide an installation tolerance. For instance, a typical 3' door requires a framed rough opening of 36½" to 39". It is desirable to provide a sill pan flashing which will fit into the opening and cover the entire rough opening width regardless of the actual dimension of the rough framing.

Figures 18A, 18B, 18C:
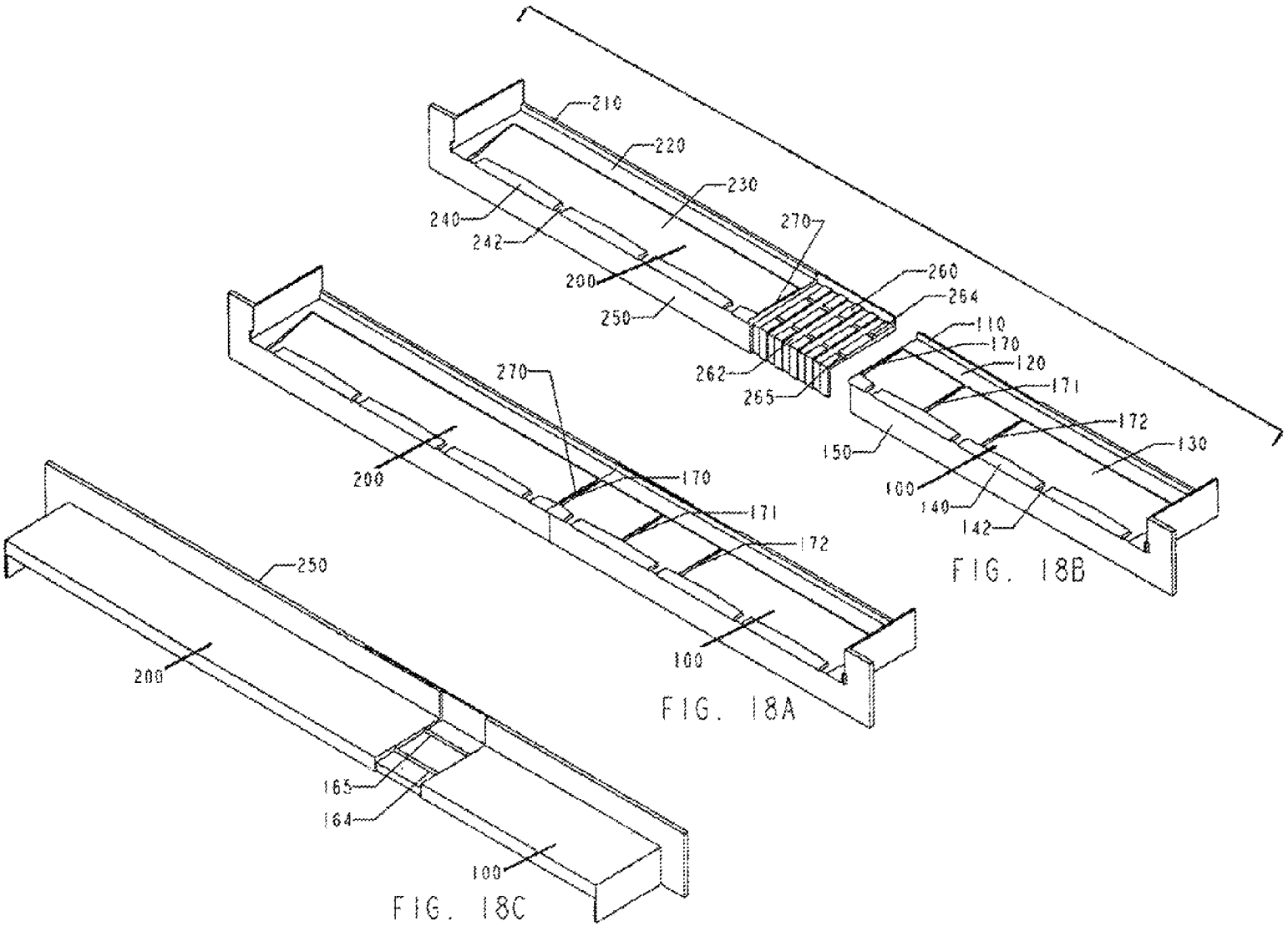
FIG. 18A is a top perspective view of an assembled two-part sliding joint sill pan flashing.
FIG. 18B is an exploded top perspective view of the two-part sliding joint sill pan flashing of FIG. 18A.
FIG. 18C is a bottom perspective view of the two-part sliding joint sill pan flashing of FIG. 18A.

FIG. 18A is a top perspective view of an assembled two-part sliding joint sill pan flashing having a first section 100 which overlaps a portion of a second section 200. In this example, the first section 100 includes a rear wall 110, a rear support 120, a sloped base top surface 130, a front support 140 with drain gaps 142, and a front face 150. The first section also includes dams 170, 171, and 172. The second section 200 includes a rear wall 210, a rear support 220, a front face 250, and an end dam 270. In this example, the first section includes a right corner, and the second section includes a left corner. The second section end dam 270 is snapped or glued between the rear support and the front support of the second section so that it retains accumulated water over the sloped base top surface 230 and directs that water to drain forward rather than toward the first section 100.

FIG. 18B is an exploded top perspective view of the two-part sliding joint sill pan flashing of FIG. 18A. In this embodiment, the second section 200 includes an end portion with ribs 260 which support the overlapping end of the first section. The support ridges 260 preferably have a downward slope toward the front of the sill pan flashing. The support ridges 260 define base drain channels 262 for draining any moisture toward the front of the sill pan flashing. The base channels 262 are preferably also sloped toward the front of the sill pan flashing. The front end of the support ridges 260 overlap the front face 250 so that there is a drainage area provided between the front faces of the top part an bottom part. The end portion also includes channels 264 and 265 for aligning with ribs 164 and 165 of the first section as shown in FIG. 18C which is a bottom perspective view of the assembled sill pan flashing. The ribbed end portion of the second section extends 3" beyond the end dam 270.

Figure 18E:
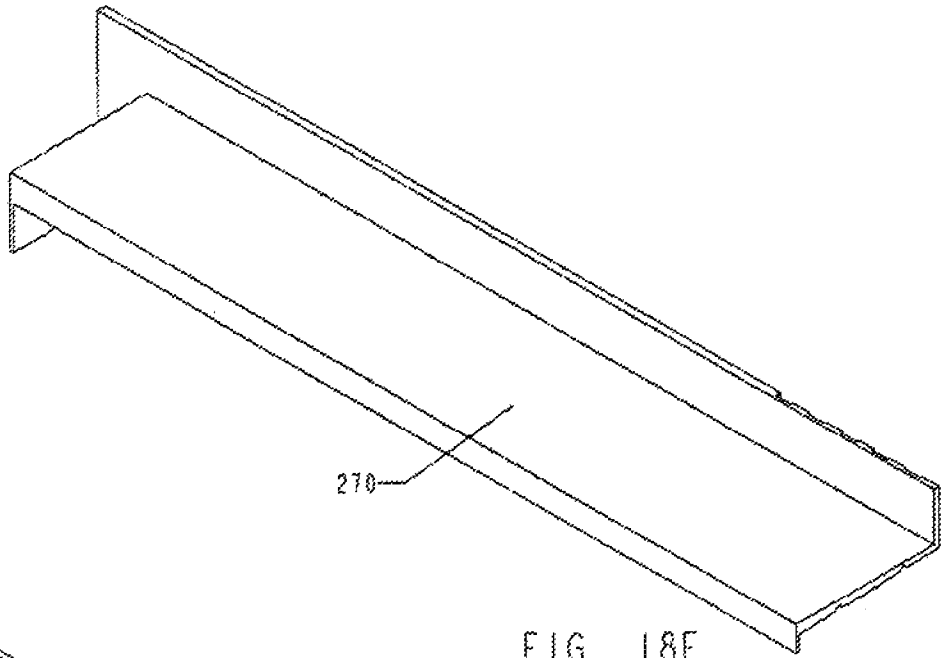
FIG. 18E is a bottom perspective view of the second section of the two-part sliding joint sill pan flashing of FIG. 18A
Figure 18D:
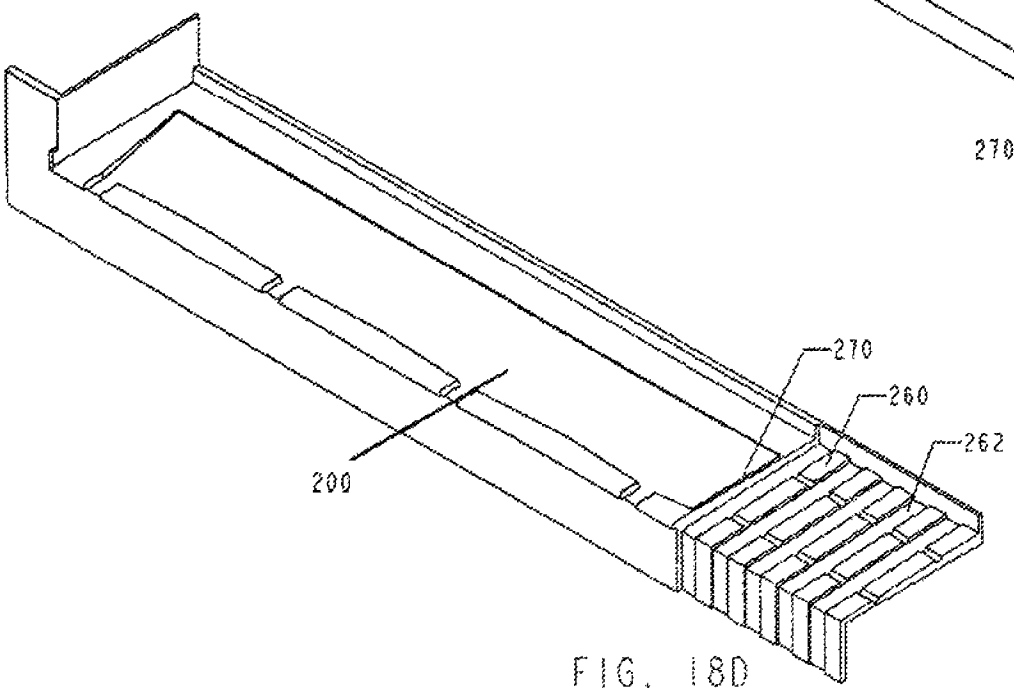
FIG. 18D is a top perspective view of the second section of the two-part sliding joint sill pan flashing of FIG. 18A

FIG. 18D is a top perspective view of the second section 200 showing details of the end dam 270, the ribs 260, drain channels 262, and alignment channels 264 and 265.

FIG. 18E is a bottom perspective view of the second section 200 showing a flat bottom surface 270.

Figure 18G:
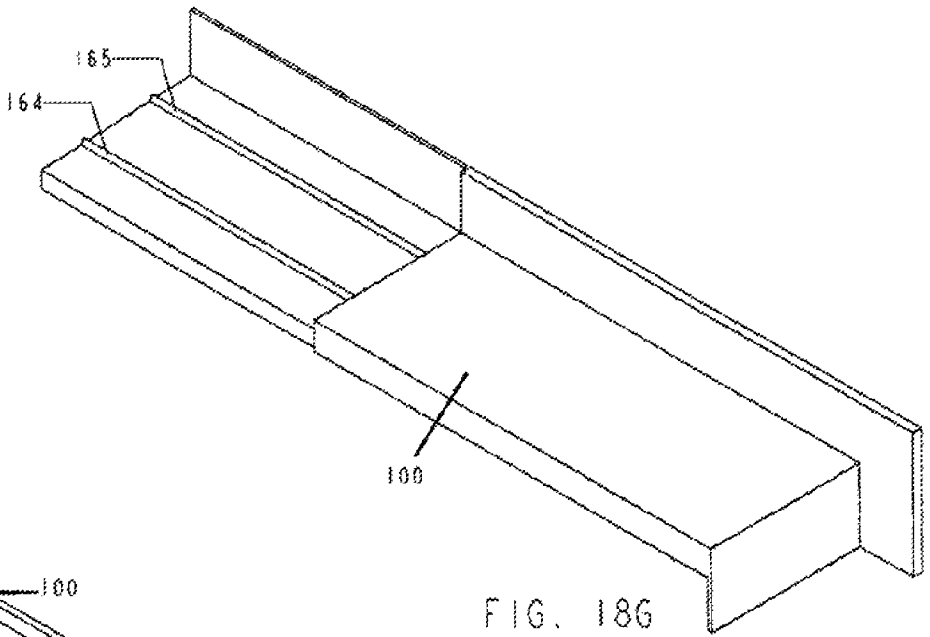
FIG. 18G is a bottom perspective view of the first section of the two-part sliding joint sill pan flashing of FIG. 18A
Figure 18F:
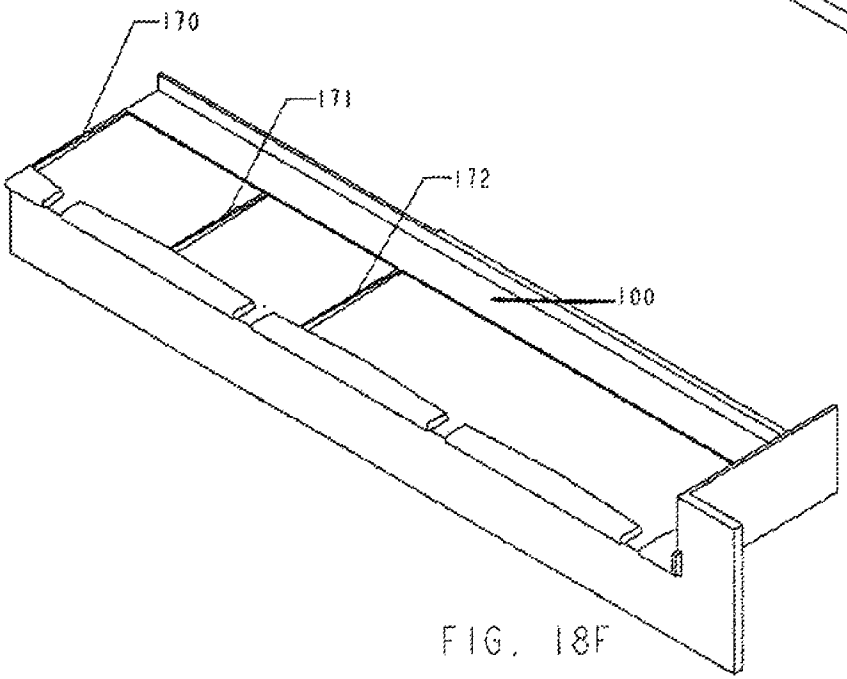
FIG. 18F is a top perspective view of the first section of the two-part sliding joint sill pan flashing of FIG. 18A

FIG. 18F is a top perspective view of the first section 100 showing details of dams 170, 171, and 172 which are preferably molded with the section.

FIG. 18G is a bottom perspective view of the first section 100 showing details of aligning ribs 164 and 165.

Figures 19A, 19B, 19C:
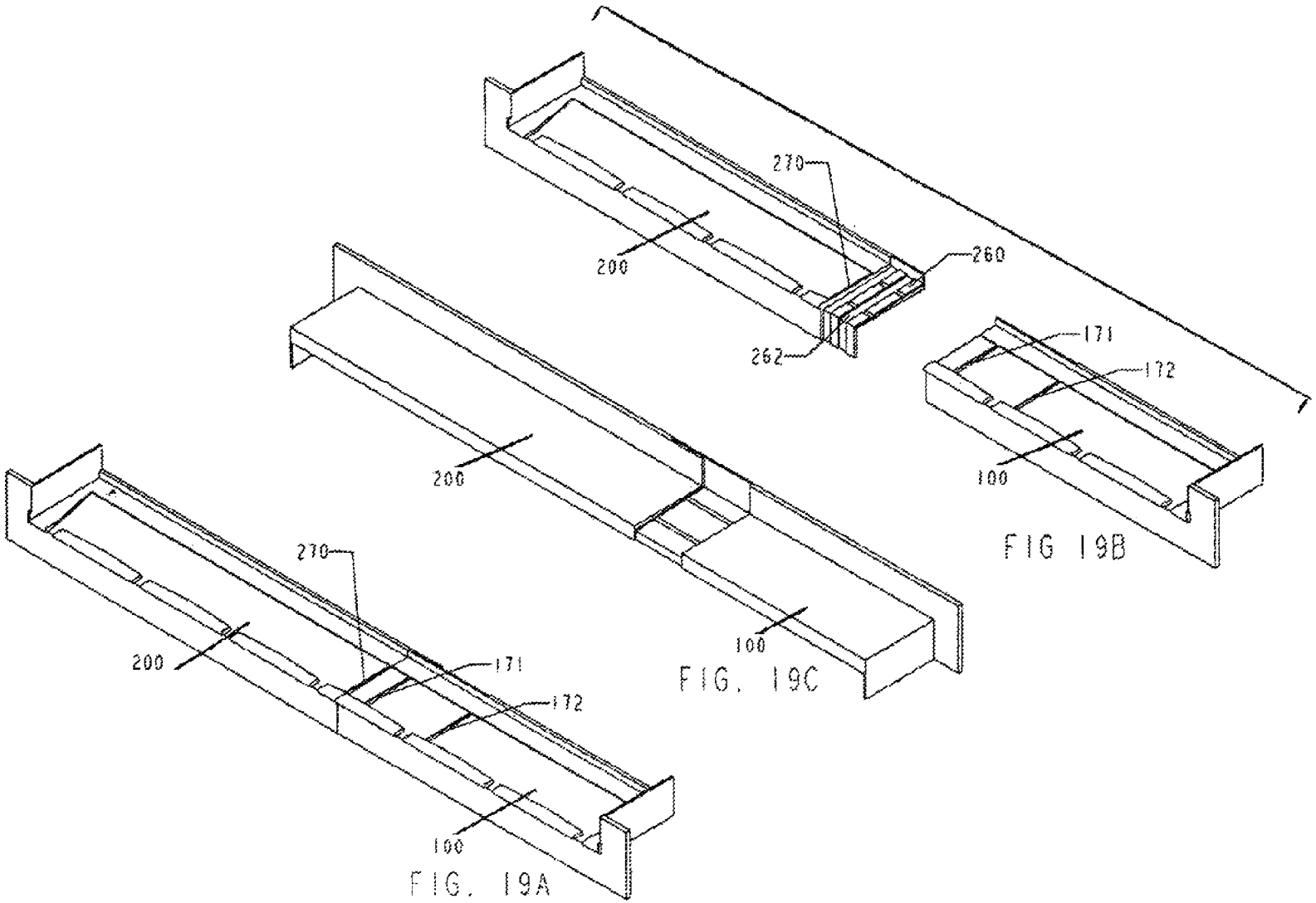
FIG. 19A is a top perspective view of an assembled two-part sliding joint sill pan flashing where the sections have been cut to a desired length.
FIG. 19B is an exploded top perspective view of the two-part sliding joint sill pan flashing of FIG. 19A.
FIG. 19C is a bottom perspective view of the two-part sliding joint sill pan flashing of FIG. 19A.

FIG. 19A is a top perspective view of an assembled two-part sliding joint sill pan flashing where the sections 100 and 200 have been cut to a desired length.

FIG. 19B is an exploded top perspective view of the two-part sliding joint sill pan flashing of FIG. 19A which shows the first section 100 cut at a point past the dam 171 and the dam 170 (not shown). In this example, the end portion of the second section 200 has also been shortened. The shortened first section and the shortened second section are assembled as shown FIG. 19C which is a bottom perspective view of the assembled sill pan flashing. In some cases it may not be necessary to cut either side, because the sliding joint feature will accommodate a range of lengths. In other cases, it is only necessary to cut one of the sections in order to create a sill pan flashing with the desired length.

In this example, the top part extends 5" beyond the top part. A typical minimum overlap between the first section and the second section is about 1½", so that the working range of this embodiment has a range of about 6½" in width. This working range may be utilized by increasing the overlap of the sections.

The top surfaces 130 and 230 of the first section and the second section may be continuously sloping. In other embodiments, the profile of the top surfaces of the sill pan flashing may be flat in the rear and front and sloping in the middle. This variable profile may enhance the interlocking between the top part and the bottom part.

The top part and bottom part sections are typically fabricated separately, and the first section is inserted over the second section. The assembly may be glued in the factory, but is designed to be snapped together without adhesive in the field.

This embodiment may be fabricated from a plastic such as PVC or a metal such as aluminum. Parts can be made by injection molding, or blow-molding plastic/PVC, or aluminum casting, or with other materials and manufacturing methods.

This embodiment provides sliding joints to accommodate variations within a range of window or door size, and in rough opening size without cutting the sill pan flashing. Alternately, the sill pan flashing can be shortened in the field by cutting a portion from the mating end of each section.

Figure 20B:
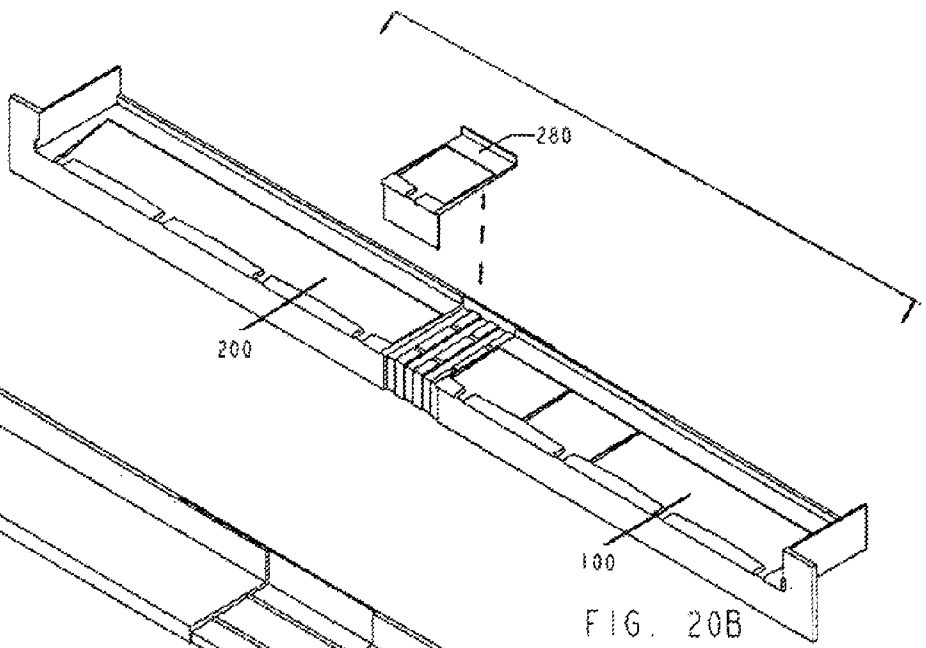
FIG. 20B is an exploded top perspective view of the two-part sliding joint sill pan flashing of FIG. 20A
Figure 20C:
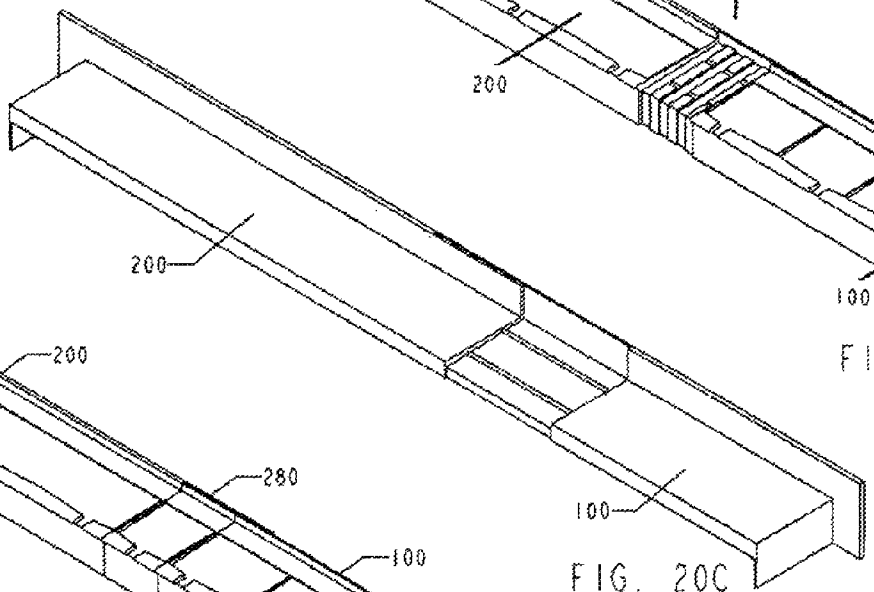
FIG. 20C is a bottom perspective view of the two-part sliding joint sill pan flashing of FIG. 20A
Figure 20A:
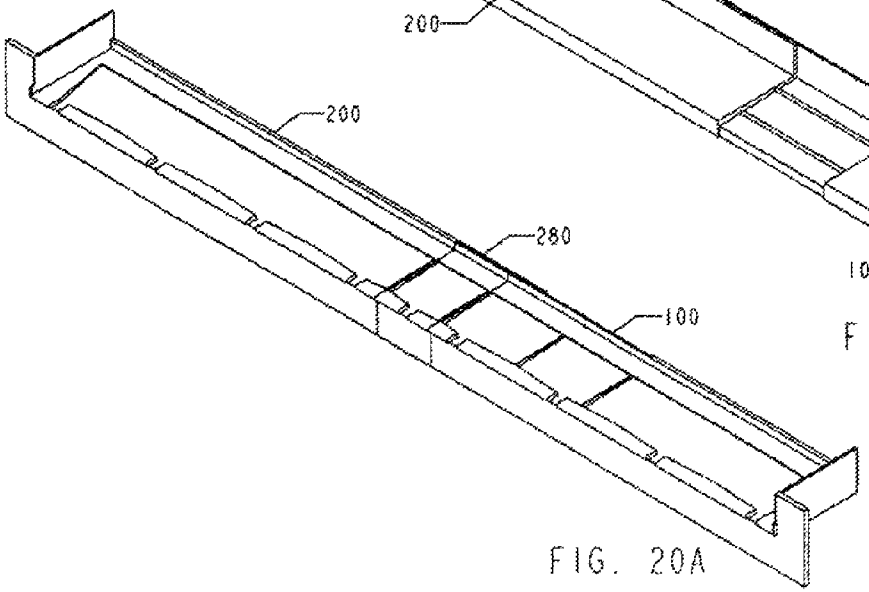
FIG. 20A is a top perspective view of an assembled two-part sliding joint sill pan flashing with a cap section.

Referring now to FIGS. 20A and 20B which are top perspective assembled and exploded views of a sill pan flashing, an optional cap section 280 may be installed over the exposed rib extensions of the second section.

Figure 21B:
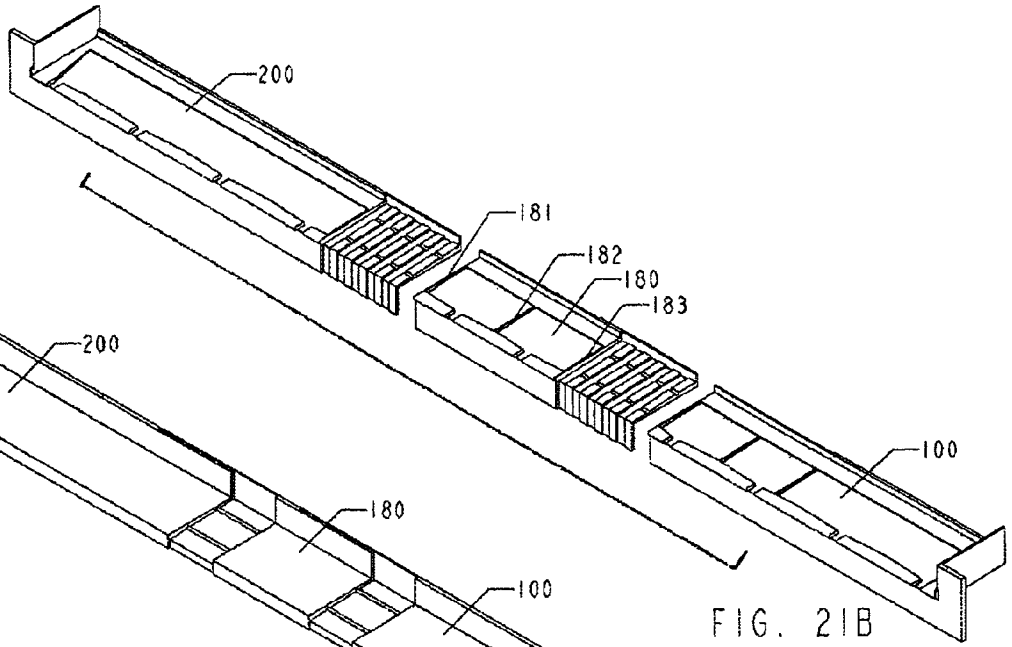
FIG. 21B is an exploded top perspective view of the sill pan flashing of FIG. 21A.
Figure 21C:
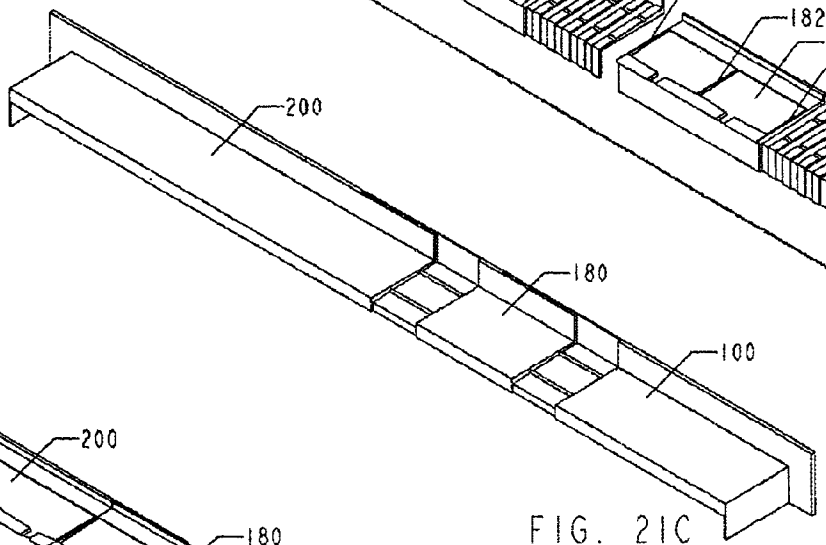
FIG. 21C is a bottom perspective view of the sill pan flashing of FIG. 21A.
Figure 21A:
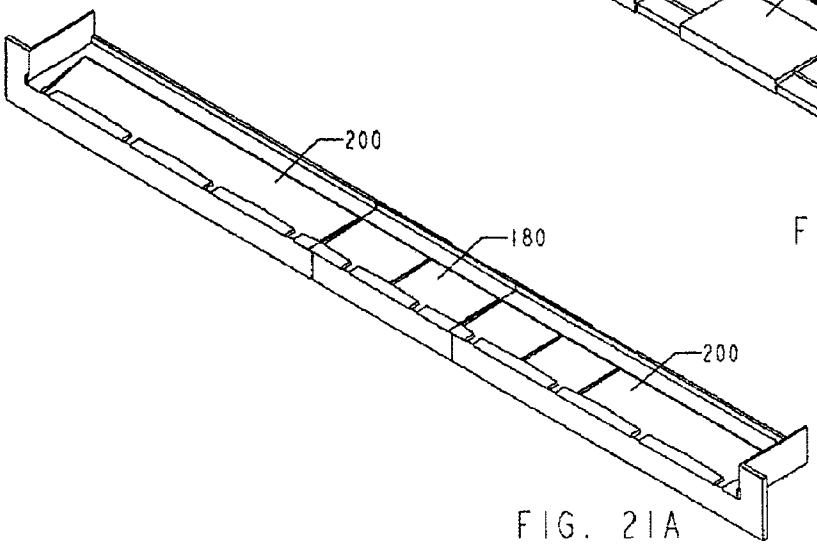
FIG. 21A is a top perspective view of an assembled two-part sliding joint sill pan flashing with a middle extension.

In this embodiment, sill pan flashing may include one or more additional middle sections such as shown in FIGS. 21A-21C. In this embodiment, each middle extension 180 has a first end, like the end of the first section, that slides over a ribbed extension; and a second end, like the end of the second section, which is a ribbed extension. Thus the sliding joints in the middle section are like the sliding joint of the two-section embodiment. The sections are preferably joined by overlapping the ends without adhesive.

In this embodiment, the adjustable sill pan flashing provides a drainable, sloped sill pan flashing for windows and doors, with a recessed slope for easy drainage and a horizontal mounting surface for windows and doors. The sliding joint design concept has a first one-piece left corner section, and a second one-piece right corner section. The first and second pieces partially slide into each other to provide an adjustable length sill pan flashing. Additional middle extensions may be inserted to allow the sill pan flashing to accommodate larger rough openings. The sliding joint design can accommodate a range of dimensions in window/door size, and in rough opening size, without cutting the pan. A further range of rough openings and standard sizes for windows and doors can be accommodated by cutting the portion of the sliding joint in the field. The sill pan flashing can be assembled quickly without glue joints or adhesives, so that the installation can be performed regardless of temperature, under any weather conditions. The parts can be made out of injection molding, or blow-molding plastic/PVC, or aluminum casting, or other materials and manufacturing methods. The preferred minimum overlap is 1.5". In this embodiment, a portion of the second section is designed to slide underneath a portion of the first section, and has a recessed slope with perpendicular ribs, to channel any water that may accumulate in the joint, or on the lower section, to the exterior of the wall cavity. There are built-in dams on the upper surfaces of all sections to prevent water from upper surfaces from spilling to a lower portion. The upper portion of all sections has a recessed slope and longitudinal ridges for installation of windows and doors, with cuts in the front ridge for drainage.

DETAILED DESCRIPTION OF EMBODIMENT

Slidable Corner Elements

Figures 23A, 23B, 23C:
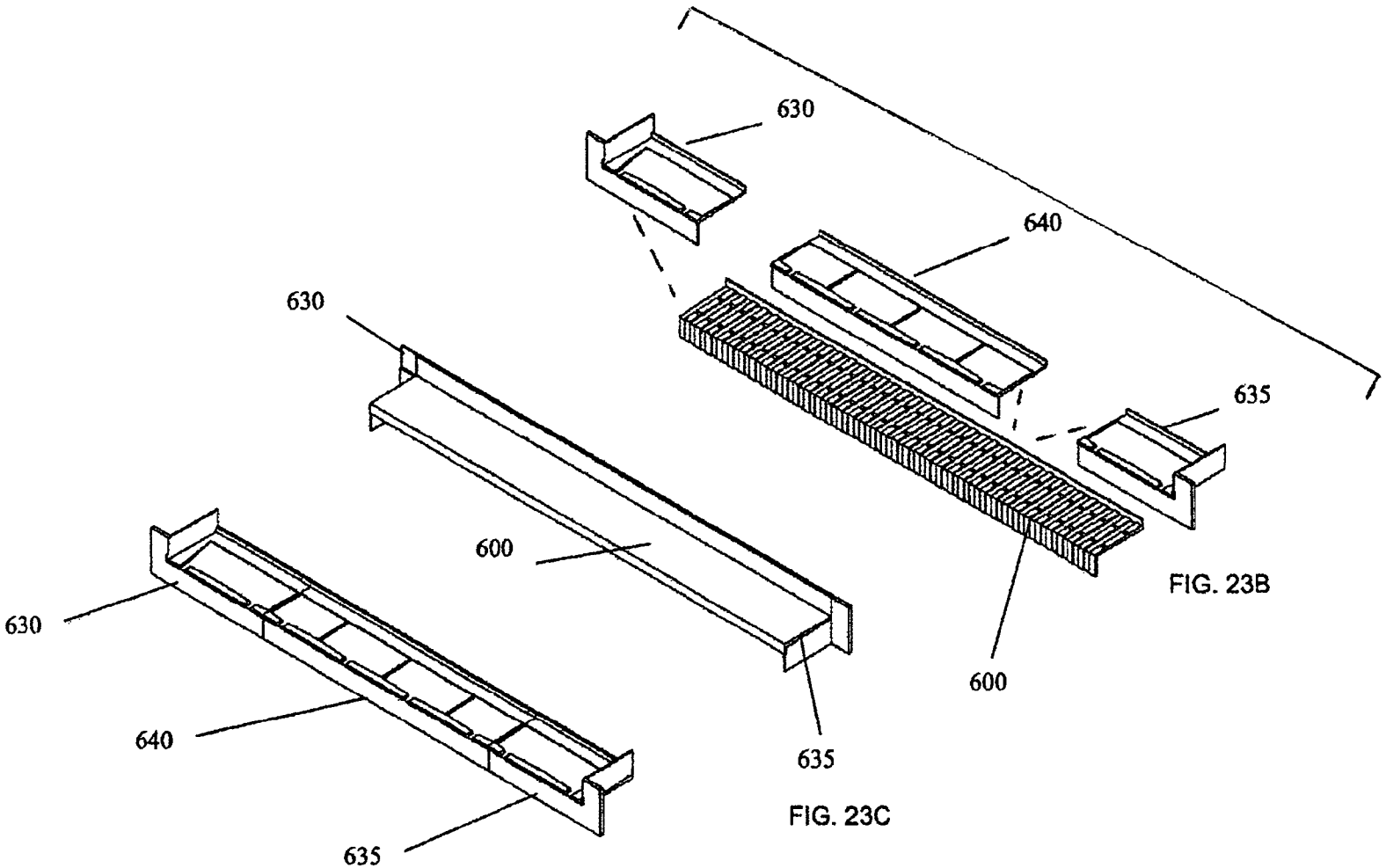
FIG. 23A is a top perspective view of an assembled adjustable sill pan flashing.
FIG. 23B is an exploded top perspective view of the sill pan flashing of FIG. 23A.
FIG. 23C is a bottom perspective view of the sill pan flashing of FIG. 23A.

FIGS. 23A-B are top perspective view of another embodiment of a slidably adjustable sill pan flashing base. In this embodiment, a left corner element 630 and a right corner element 635 fit adjustably over a base element 600. A cap element 640 may be inserted over the exposed base unit between the corner elements. FIG. 23C is a bottom perspective view of the assembled pan.

Figure 23E:
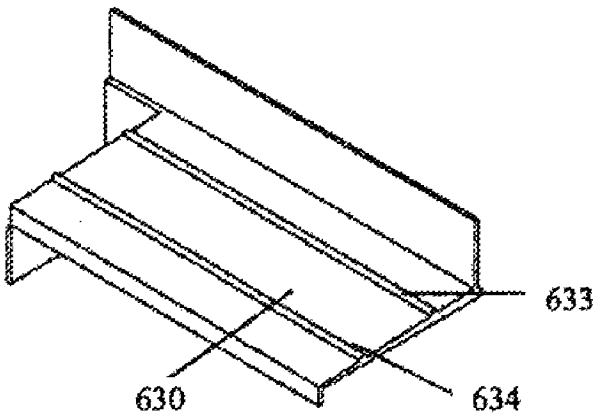
FIG. 23E is a bottom perspective view of the left corner element of FIG. 23D.
Figure 23D:
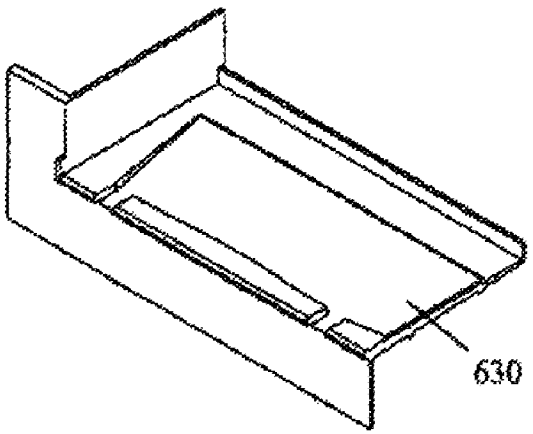
FIG. 23D is a top perspective view of a left corner element for the sill pan flashing of FIG. 23A.

FIGS. 23D-E are top and perspective views of a left corner element for the sill pan flashing of FIG. 23A. The corner element includes front and rear supports and a dam element as discussed in embodiments above. The corner element includes ribs 633 and 634 for aligning with corresponding channels in the base unit.

Figure 23G:
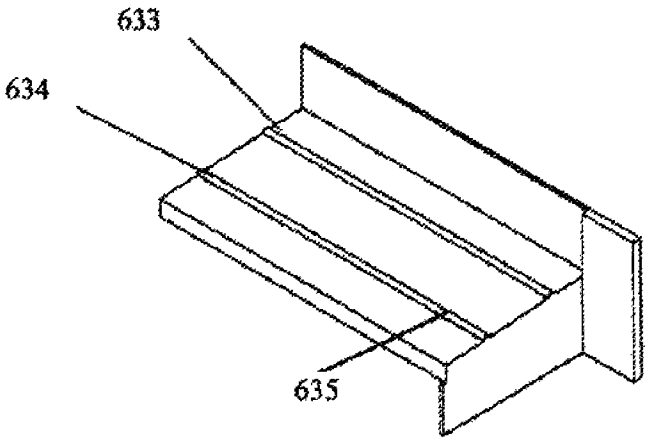
FIG. 23G is a bottom perspective view of the right corner element of FIG. 23F.
Figure 23F:
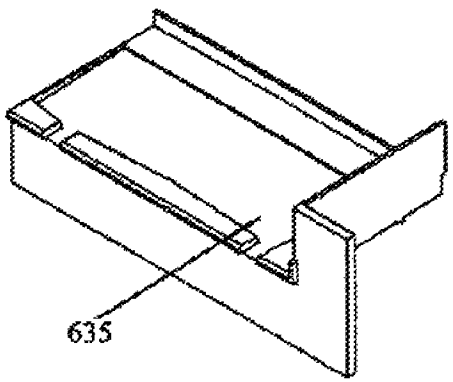
FIG. 23F is a top perspective view of a right corner element for the sill pan flashing of FIG. 23A.

FIGS. 23F-G are top and perspective views of a right corner element for the sill pan flashing of FIG. 23A. The corner element includes front and rear supports and a dam element as discussed in embodiments above. The corner element includes ribs 633 and 634 for aligning with corresponding channels in the base unit.

Figure 23I:
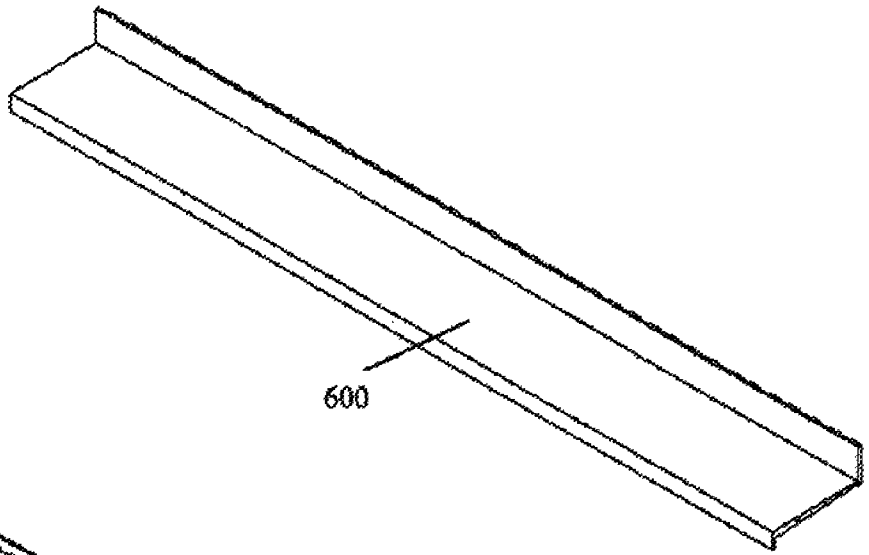
FIG. 23I is a bottom perspective view of the bottom element of FIG. 23H.
Figure 23H:
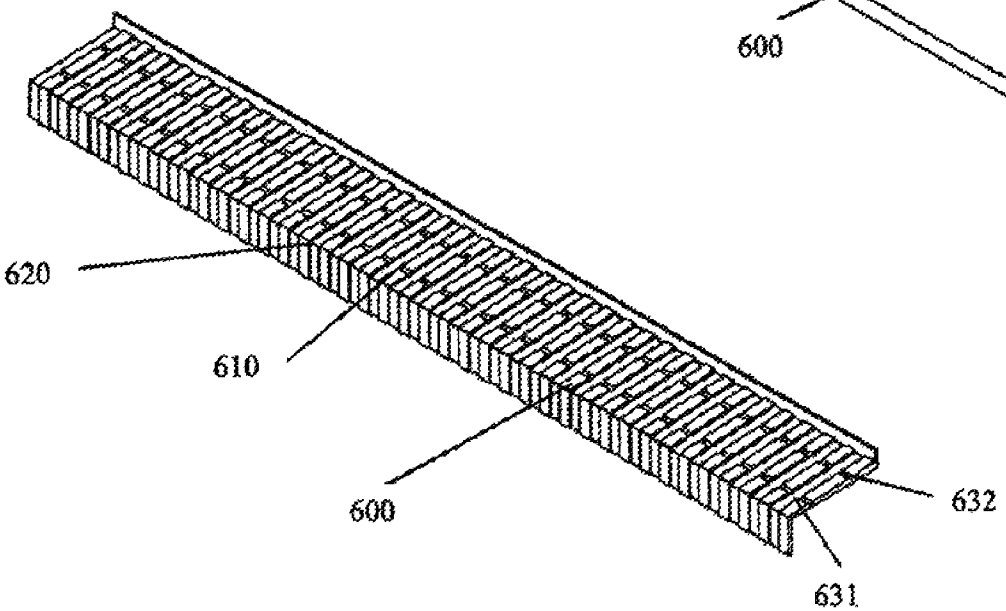
FIG. 23H is a top perspective view of a bottom element for the sill pan flashing of FIG. 23A.

FIGS. 23H-I are top and perspective views of a base unit for the sill pan flashing of FIG. 23A. The base unit includes a plurality of support ridges 610. The support ridges define base drain channels 620 which are preferably sloped toward the front of the base unit in order to draining any moisture toward the front of the sill pan flashing. The recessed surface between the support ridges may slope towards the front. In some embodiments, the support ridges may also slope to the front of the sill pan flashing. The base unit also includes channels 631 and 632 for aligning with ribs 633 and 634 of the corner sections 630 and 635.

In one embodiment, the base element is cut to a desired rough opening width after allowing for the corner sections. The base can be cut to rough opening size or slightly less.

In one embodiment, corner sections fit on top of the base unit, and no adjustment in the length of the base unit is needed due to corners. Corners should overlap the base sufficiently for the weight of windows and doors to be transferred to the structure. This assembly is easily accommodates thermal expansion or contraction of windows and doors and the wall structure, due to sliding joint design. The corner sections are then assembled on the base unit, and may be adjusted by sliding the corner sections along the ends of the base unit. The corners are preferably placed on ends of the base unit with the slide-in joint and without glue.

Figure 23K:
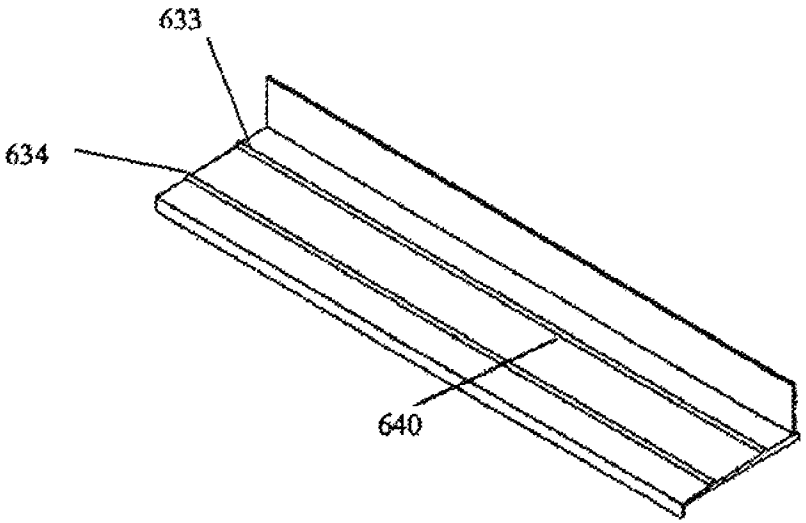
FIG. 23K is a bottom perspective view of the cap element of FIG. 23J.
Figure 23J:
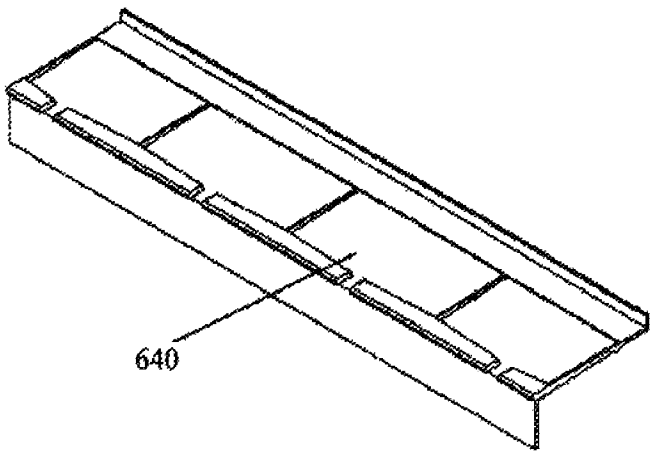
FIG. 23J is a bottom perspective view of a cap element for the sill pan flashing of FIG. 23A.
Figure 24:
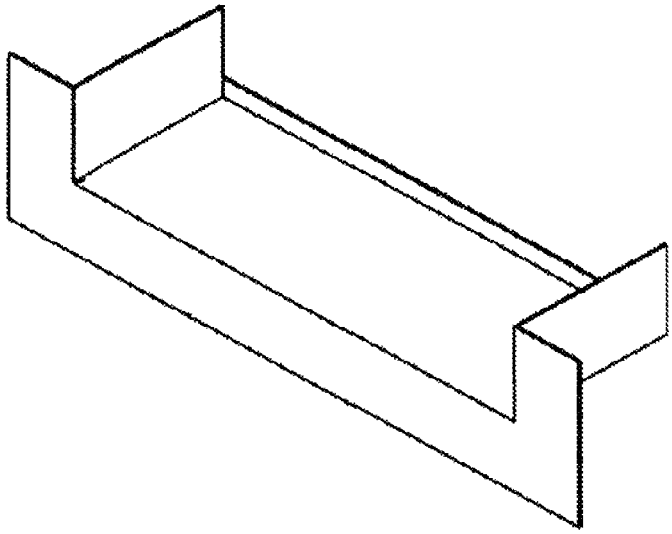
FIG. 24 (Prior Art)
FIG. 24 is a prior art perspective view of a sill pan flashing as illustrated in ASTM E 2112-07.

FIGS. 23J-K are top and perspective views of a cap element 640 for the sill pan flashing of FIG. 23A. The corner element includes front and rear supports and dam elements as discussed in embodiments above. The cap element may be cut to length to fit between the corner pieces. The cap element may include ribs 633 and 634 to snap into the channels 631 and 632 of the base unit. In some embodiments, there may be more than one base section and more then one top plate assembling the unit. For example, base section and top plate could be manufactured in 38" lengths, and then either cut to smaller size to fit the opening or multiple pieces used for wider openings. The top plate should generally be the length of the base plate minus two corners that are installed on the base plate.

DETAILED DESCRIPTION OF EMBODIMENT

Plastic Sill Pan Flashing with Rear and Front Drainage Channels

Figure 22B:
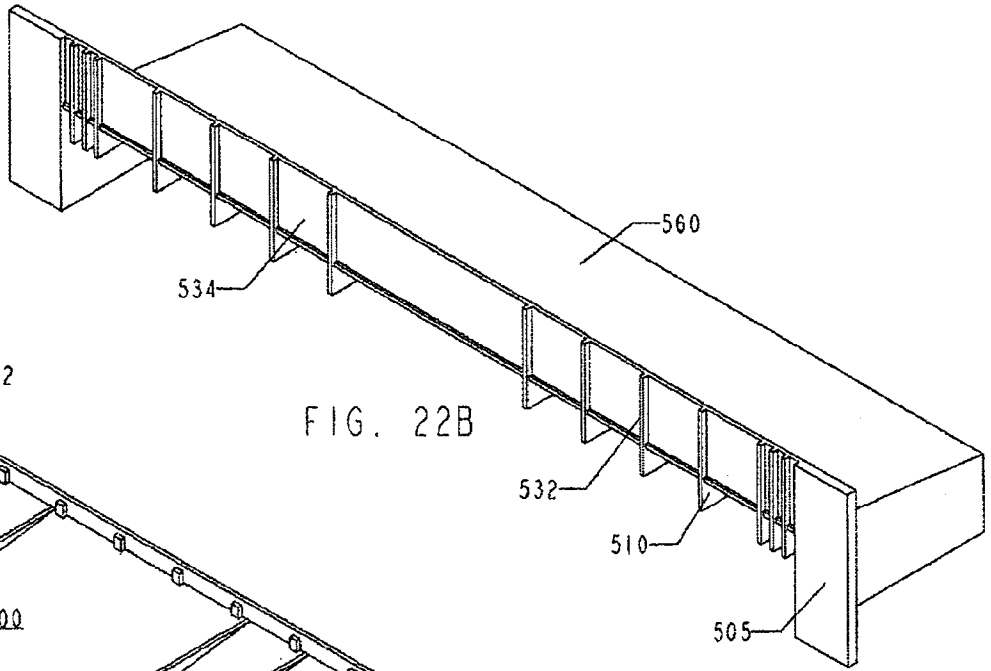
FIG. 22B is a bottom perspective view of the sill pan flashing of FIG. 22A.
Figure 22A:
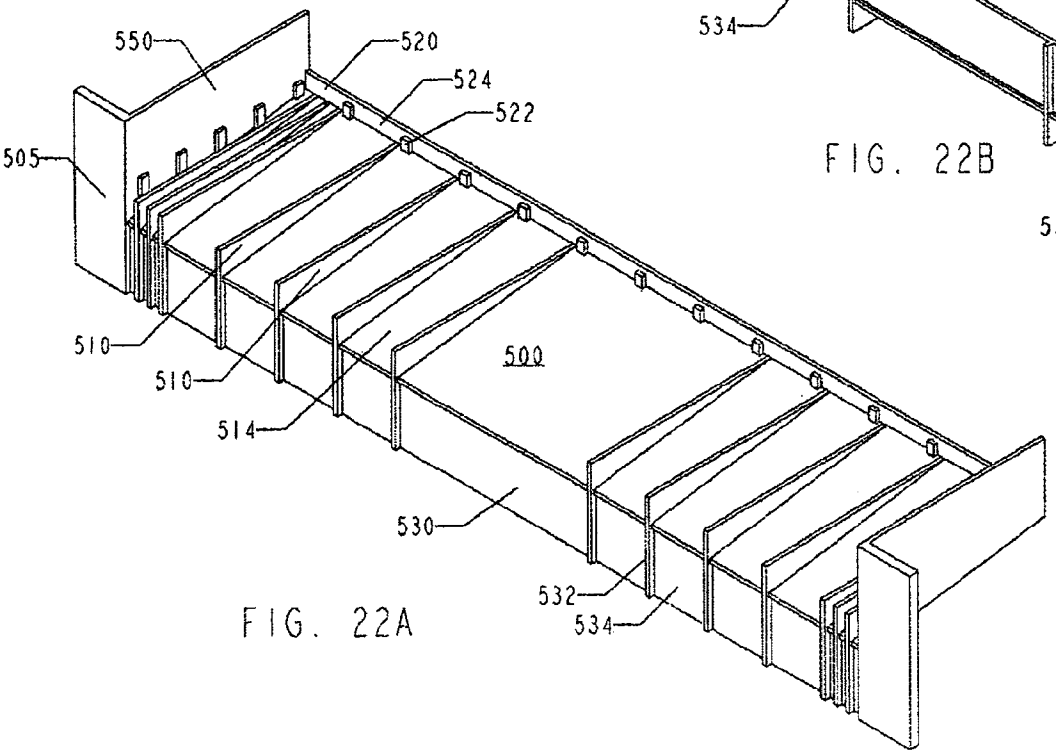
FIG. 22A is a top perspective view of an alternate embodiment of the sill pan flashing.

FIG. 22A which is a top perspective view of an alternate embodiment of the invention. In this embodiment, the sill pan flashing has a base 500 which may have a downwardly sloping top surface or a relatively flat top surface. In the case of a relatively flat top surface, a portion of the moisture that collects on the base is dissipated by evaporation. In this embodiment, the sill pan flashing has a plurality of ridge supports 510 that may be provided with a regular or an irregular spacing. Irregular spacing of the ridge supports permits more supports to be placed closer to the ends of the sill pan flashing in areas that typically bear more of a door or window load than the central portions.

The sill pan flashing includes a rear wall 520 which preferably includes offsets 522. These offsets provide rear drainage channels 524 which permit moisture to drain from the rear of the window or door through the rear drainage channels into base drainage channels 514 formed between the support ridges 510. The sill pan flashing includes a front plate 530 which extends downward from the front edge of the base. The front plate preferably includes offsets 532, which provide front drainage channels 534 for the base drainage channels 514. The combination of the rear drainage channels, the base drainage channels, and the front drainage channels provides a continuous drain path for moisture which may accumulate on the sill pan flashing.

Each end of the sill pan flashing base 500 includes a side plate 550 which may include offsets 552 (not shown) to provide side drainage channels 554 (not shown) to the base. The offsets may be angled in order to provide bracing to a molded corner section. The end pieces preferably include a front plate 505 which extends above and below the base. The sill pan flashing is typically secured to the framing by staples across the corners of the front plate 505, or by bending a nail over the front plate 505.

FIG. 22B which is a bottom perspective view of an alternate embodiment of the invention illustrates a flat base 560 for the sill pan flashing.

What is claimed is:

1. A sill pan flashing system to protect the rough opening of a window or door from water intrusion, the sill pan flashing system comprising a rough opening comprising a bottom, a first side, and a second side;

a sill pan flashing comprising a sill pan flashing base positioned in the bottom of the rough opening, the sill pan flashing base comprising a first end, a second end a sloped upper portion, a rear wall, a front flange, a lengthwise oriented rear sill support, and a lengthwise oriented front sill support comprising a plurality of drain gaps, a first end piece comprising an end piece base having a top surface, a bottom surface, a first side edge, a second side edge, a rear edge, and a front edge, such that the end piece base is attached to the sill pan flashing base in the proximity of the first end of the sill pan flashing base, a side upward lip projecting from the top surface of the end piece base along the second side edge, the side upward lip extending from the front edge to the rear edge of the end piece base such that the side upward lip is in proximity to a first side of the rough opening, a downwardly extending front lip projecting from the top surface of the end piece base along the front edge, the downwardly extending front lip extending from the first side edge to the second side edge of the end piece base, and a corner side flange attached to the first side of the rough opening; and a second end piece comprising an end piece base having a top surface, a bottom surface, a first side edge, a second side edge, a rear edge, and a front edge, such that the end piece base is attached to the sill pan flashing base in the proximity of the first end of the sill pan flashing base, a side upward lip projecting from the top surface of the end piece base along the second side edge, the side upward lip extending from the front edge to the rear edge of the end piece base such that the side upward lip is in proximity to a second side of the rough opening, a downwardly extending front lip projecting from the top surface of the end piece base along the front edge, the downwardly extending front lip extending from the first side edge to the second side edge of the end piece base, and a corner side flange attached to the second side of the rough opening; and a window or door with a window or door sill supported by the lengthwise oriented rear sill support and lengthwise oriented front sill support of the sill pan flashing.

2. The sill pan flashing of claim 1 wherein the sill pan flashing base is constructed of a plastic.

3. The sill pan flashing of claim 1 wherein the sill pan flashing base is constructed of a metal.

4. The sill pan flashing of claim 1 wherein the first end piece snaps onto the first end of the sill pan flashing base.

5. The sill pan flashing of claim 4 wherein the first end piece includes at least one projecting portion; and the first end of the sill pan flashing base includes a slot which accepts the projecting portion.

6. The sill pan flashing of claim 1 wherein the first end piece is glued onto the first end of the sill pan flashing base.

* * * * *